US008723753B2

(12) United States Patent
Kato et al.

(10) Patent No.: US 8,723,753 B2
(45) Date of Patent: May 13, 2014

(54) ANTENNA DEVICE AND COMMUNICATION TERMINAL APPARATUS

(75) Inventors: Noboru Kato, Nagaokakyo (JP); Satoshi Ishino, Nagaokakyo (JP); Kenichi Ishizuka, Nagaokakyo (JP); Noriyuki Ueki, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 246 days.

(21) Appl. No.: 13/286,296

(22) Filed: Nov. 1, 2011

(65) Prior Publication Data

US 2012/0112979 A1 May 10, 2012

(30) Foreign Application Priority Data

Nov. 5, 2010 (JP) ..... 2010-248670

(51) Int. Cl.
*H01Q 21/00* (2006.01)

(52) U.S. Cl.
USPC ..... 343/853; 343/860

(58) Field of Classification Search
USPC ..... 343/853, 860; 333/17.3, 32
See application file for complete search history.

(56) References Cited

U.S. PATENT DOCUMENTS

| | | | | |
|---|---|---|---|---|
| 7,015,870 | B2 * | 3/2006 | Guitton et al. | 343/860 |
| 7,079,877 | B2 | 7/2006 | Shoji et al. | |
| 7,786,949 | B2 * | 8/2010 | Kato | 343/860 |
| 2005/0190107 | A1 | 9/2005 | Takagi et al. | |
| 2011/0309994 | A1 * | 12/2011 | Kato et al. | 343/860 |
| 2012/0056795 | A1 * | 3/2012 | Nagumo et al. | 343/787 |
| 2012/0139814 | A1 * | 6/2012 | Ishizuka et al. | 343/860 |

FOREIGN PATENT DOCUMENTS

| | | | |
|---|---|---|---|
| CN | 1661855 | A | 8/2005 |
| JP | 2000-244273 | A | 9/2000 |
| JP | 2002-335180 | A | 11/2002 |
| JP | 2007-288741 | A | 11/2007 |
| JP | 2008-245132 | A | 10/2008 |
| JP | 2009-246560 | A | 10/2009 |

* cited by examiner

*Primary Examiner* — Tan Ho
(74) *Attorney, Agent, or Firm* — Keating & Bennett, LLP

(57) ABSTRACT

An antenna device includes a first antenna element that resonates with a first resonant frequency, a second antenna element that resonates with a second resonant frequency, a first frequency stabilizing circuit connected to a feeding end of the first antenna element, and a second frequency stabilizing circuit connected to a feeding end of the second antenna element. The first antenna element and the second antenna element can be arranged along two sides of a case of a communication terminal apparatus, for example.

7 Claims, 34 Drawing Sheets

ANTENNA DEVICE AND COMMUNICATION TERMINAL APPARATUS

BACKGROUND OF THE INVENTION

1. Field of the Invention

The present invention relates to an antenna device in which a plurality of antenna elements are assembled and to a communication terminal apparatus that includes such an antenna device.

2. Description of the Related Art

Recently, multiple-input and multiple-output (MIMO) technology has been used in some high-speed communication terminal apparatuses, such as wireless LAN apparatuses, and communication terminal apparatuses, such as next-generation cellular phones. A system using MIMO technology includes a plurality of antenna elements in each of a transmitting terminal and a receiving terminal. The transmitting terminal can transmit a plurality of data units at the same time with the same frequency at a time using the plurality of antenna elements. Accordingly, the communication speed in a limited frequency band can be improved.

However, for application of MIMO technology to, in particular, a small communication terminal apparatus, such as a mobile communication terminal apparatus, because the case size of the communication terminal apparatus is limited, the plurality of antenna elements are inevitably adjacent to each other and thus it is difficult to have sufficient isolation between the antenna elements.

Example techniques for ensuring isolation characteristics between antenna elements by the use of a magnetic wall or a meandering conductive pattern between two antenna elements are disclosed in Japanese Unexamined Patent Application Publication Nos. 2008-245132 and 2009-246560.

FIG. 34 illustrates the configuration of a wireless device disclosed in Japanese Unexamined Patent Application Publication No. 2008-245132. In FIG. 34, a wireless device 1 includes a circuit board 91 disposed in a case 90. The wireless device 1 also includes a first feeding point 93 and a second feeding point 94 in the vicinity of a first longitudinal side of the circuit board 91. The first feeding point 93 is connected to a first antenna element 95. The second feeding point 94 is connected to a second antenna element 96. The wireless device 1 further includes a planar magnetic body 97. The magnetic body 97 is arranged so as to shield at least a portion of the second antenna element 96 from at least a portion of the first antenna element 95.

However, these techniques may be unable to ensure sufficient isolation between two antenna elements, depending on the arrangement of the antenna elements and the shape and size of each antenna element. In addition, the necessity of an isolation element, such as a magnetic wall between two antenna elements or a meandering conductive pattern, complicates the configuration and the manufacturing process.

SUMMARY OF THE INVENTION

Accordingly, preferred embodiments of the present invention provide an antenna device allowing greater design flexibility in, for example, the arrangement of a plurality of antenna elements and the shape and size of each antenna element and having a simple configuration that does not necessarily have to include an isolation element, and also provide a communication terminal apparatus including such an antenna device.

An antenna device according to a preferred embodiment of the present invention preferably includes a first antenna element that resonates with a first resonant frequency, a second antenna element that resonates with a second resonant frequency, and at least one frequency stabilizing circuit connected to a feeding end of at least one of the first antenna element and the second antenna element. The frequency stabilizing circuit includes a first series circuit (primary circuit) and a second series circuit (secondary circuit). The first series circuit includes a first coil conductor and a second coil conductor connected in series to the first coil conductor. The second series circuit includes a third coil conductor and a fourth coil conductor connected in series to the third coil conductor. The first coil conductor and the second coil conductor are wound so as to define a first closed magnetic circuit. The third coil conductor and the fourth coil conductor are wound so as to define a second closed magnetic circuit. The first closed magnetic circuit and the second closed magnetic circuit are coupled to each other.

In the antenna device, the first resonant frequency and the second resonant frequency may be different from each other.

In the antenna device, the first resonant frequency and the second resonant frequency may differ from a frequency of a communication carrier wave.

In the antenna device, one of the frequency stabilizing circuits may be connected to the feeding end of the first antenna element and another one of the frequency stabilizing circuits may be connected to the feeding end of the second antenna element.

In the antenna device, the first coil conductor and the third coil conductor may be magnetically coupled to each other, and the second coil conductor and the fourth coil conductor may be magnetically coupled to each other.

In the antenna device, the first coil conductor, the second coil conductor, the third coil conductor, and the fourth coil conductor may be configured in a dielectric or magnetic laminate body.

A communication terminal apparatus according to another preferred embodiment of the present invention preferably includes a first antenna element that resonates with a first resonant frequency, a second antenna element that resonates with a second resonant frequency, and at least one frequency stabilizing circuit connected to a feeding end of at least one of the first antenna element and the second antenna element. The frequency stabilizing circuit includes a first series circuit (primary circuit) and a second series circuit (secondary circuit). The first series circuit includes a first coil conductor and a second coil conductor connected in series to the first coil conductor. The second series circuit includes a third coil conductor and a fourth coil conductor connected in series to the third coil conductor. The first coil conductor and the second coil conductor are wound so as to define a first closed magnetic circuit. The third coil conductor and the fourth coil conductor are wound so as to define a second closed magnetic circuit. The first closed magnetic circuit and the second closed magnetic circuit are coupled to each other.

According to the antenna device of various preferred embodiments of the present invention, the frequency stabilizing circuit, which preferably has the above-described configuration, virtually serves the functions of (1) setting a center frequency, (2) setting a passband, and (3) matching with a feeder circuit, from among the antenna characteristics. Accordingly, the antenna element is simply required to be designed so as to mainly perform the functions of (4) setting a directivity and (5) ensuring a gain, from among the antenna characteristics. Therefore, the antenna device allowing greater design flexibility in, for example, the arrangement of a plurality of antenna elements and the shape and size of each antenna element and having a simple configuration that does not necessarily have to include an isolation element can be achieved.

According to the communication terminal apparatus of various preferred embodiments of the present invention, as described above, because of greater design flexibility in, for example, the arrangement of a plurality of antenna elements and the shape and size of each antenna element and the unnessesity of an isolation element between the antenna elements, the small communication terminal apparatus can be achieved.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

First Preferred Embodiment

Figure 1:
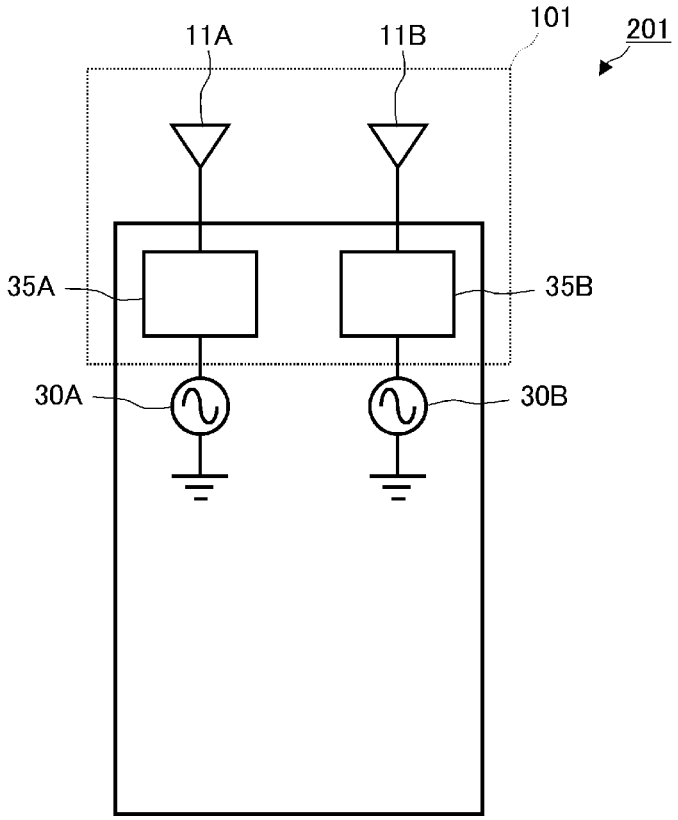
FIG. 1 illustrates a schematic configuration of an antenna device and a communication terminal apparatus including such an antenna device according to a first preferred embodiment of the present invention.

FIG. 1 illustrates a schematic configuration of an antenna device 101 and a communication terminal apparatus 201 including the antenna device 101 according to a first preferred embodiment of the present invention. The communication terminal apparatus 201 includes the antenna device 101 and feeder circuits 30A and 30B to supply power to the antenna device 101. The antenna device 101 includes a first antenna element 11A that resonates with a first resonant frequency f1, a second antenna element 11B that resonates with a second resonant frequency f2, a first frequency stabilizing circuit 35A connected to a feeding end of the first antenna element 11A, and a second frequency stabilizing circuit 35B connected to a feeding end of the second antenna element 11B.

In the case where a communication apparatus connected to the antenna device 101 is a circuit that communicates using multiple-input and multiple-output (MIMO) technology, the first resonant frequency f1 of the first antenna element 11A and the second resonant frequency f2 of the second antenna element 11B are the same. As described below, because the center frequency of an antenna is determined by the action of a frequency stabilizing circuit, the first resonant frequency f1 and the second resonant frequency f2 may differ from a frequency f0 of a communication carrier wave. Typically, for the sake of miniaturization of the device, the first antenna element 11A and the second antenna element 11B are made smaller, so the resonant frequency of each of the first antenna element 11A and the second antenna element 11B is higher than the frequency f0 of a communication carrier wave.

MIMO is wireless communication technology of data transmission and reception using multiple antennas. With this technology, which uses multiple antennas at both the transmitter and receiver, the transmitter transmits a plurality of data units at the same time with the same frequency at a time using the plurality of antennas, and the receiver combines and separates received signals by matrix operation and decodes them. Accordingly, it is important for the plurality of (for example, two in the first preferred embodiment) antenna elements to be able to simultaneously transmit or receive data.

In the case of an antenna diversity configuration, it is important that the plurality of (for example, two in the first preferred embodiment) antenna elements have different directional patterns and they complement each other.

Figure 2:
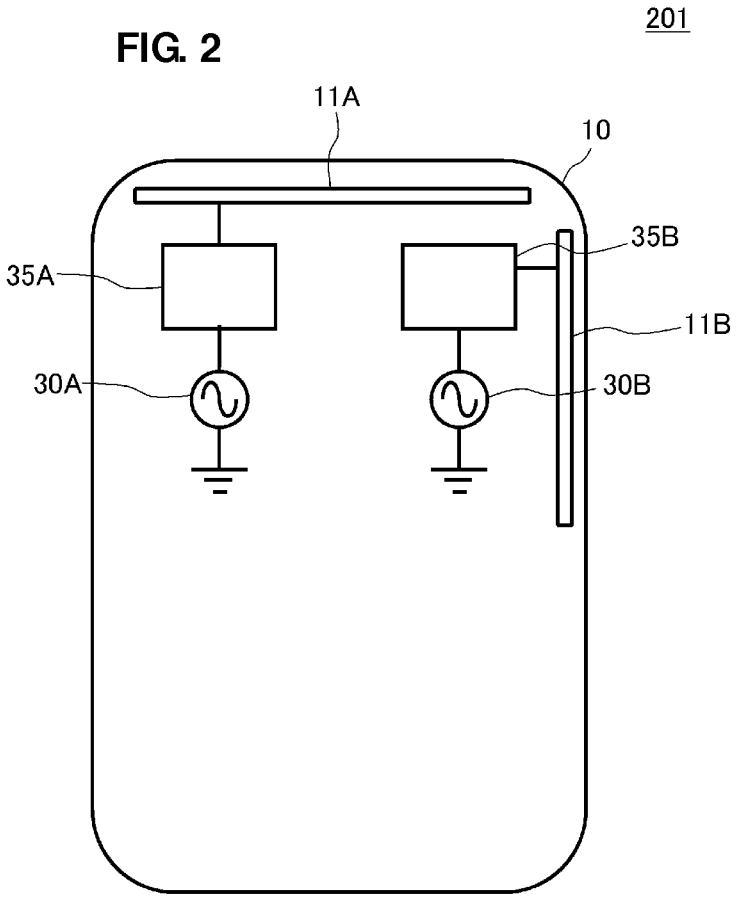
FIG. 2 illustrates a specific configuration of the antenna device in the communication terminal apparatus.

As illustrated in FIG. 2, the first antenna element 11A and the second antenna element 11B are arranged along two sides of a case 10 of the communication terminal apparatus 201. In this manner, two antenna elements can be disposed in a limited space.

FIG. 2 illustrates a specific configuration of the antenna device 101 inside the communication terminal apparatus 201. The first antenna element 11A is arranged along a shorter side of the case of the communication terminal apparatus 201. The second antenna element 11B is arranged at a location relatively near to the first antenna element 11A along a longer side of the case of the communication terminal apparatus 201.

Figure 3A:
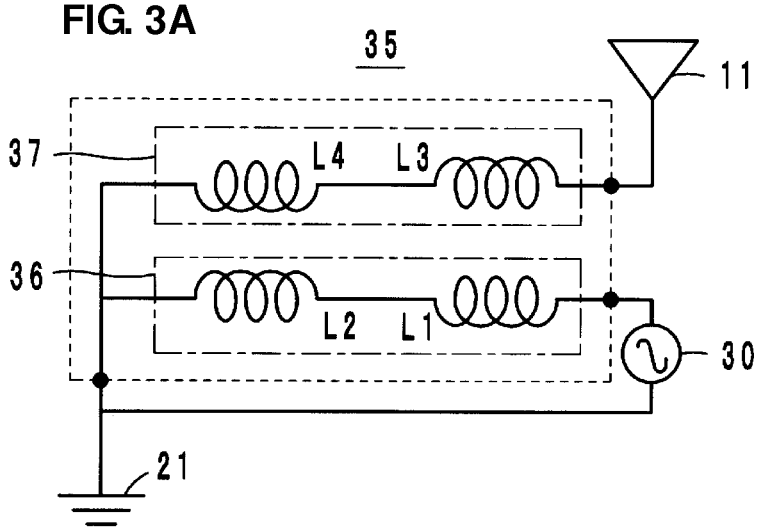
FIGS. 3A, 3B, and 3C illustrate a configuration of a frequency stabilizing circuit.
Figure 3B:
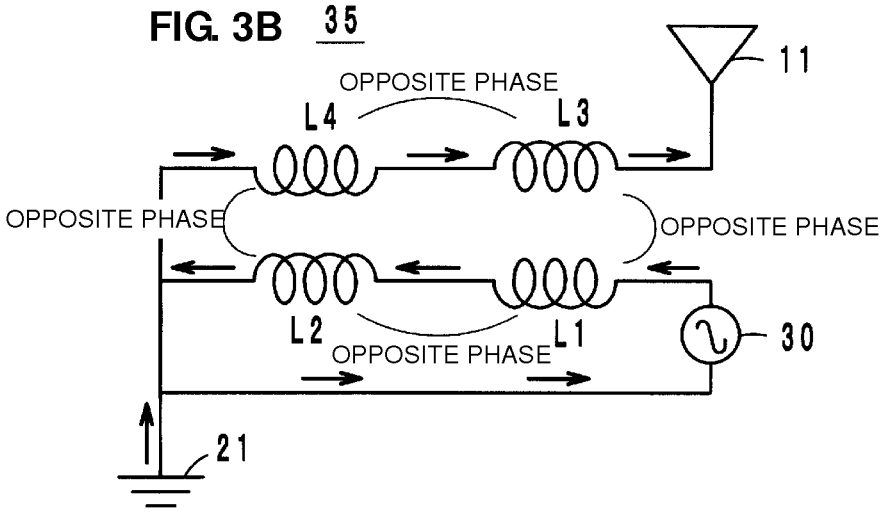
Figure 3C:
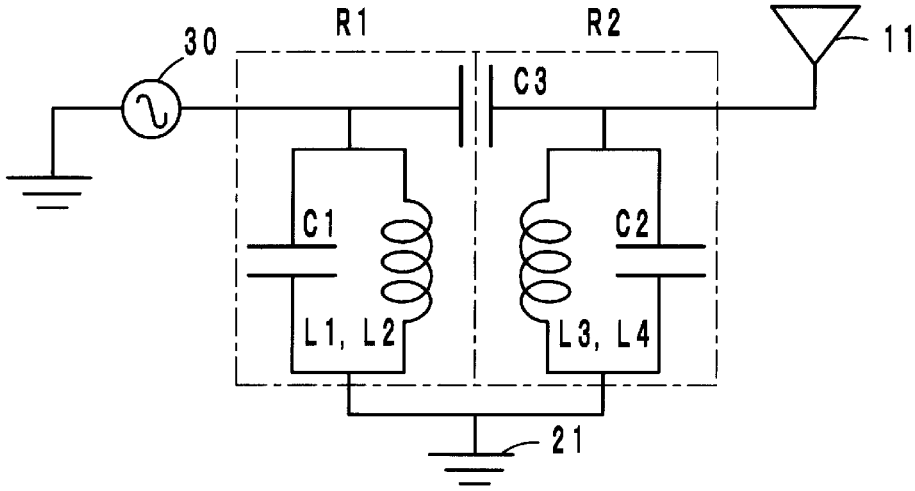

FIGS. 3A to 3C illustrate a configuration of the frequency stabilizing circuits 35A and 35B. These two frequency stabilizing circuits 35A and 35B have the same configuration; in FIGS. 3A to 3C, they are referred to simply as the frequency stabilizing circuit 35. The antenna elements 11A and 11B illustrated in FIGS. 1 and 2 are indicated by the first radiator 11 in FIGS. 3A to 3C. The ground electrode connected to one end of each of the feeder circuits 30A and 30B is indicated by a second radiator 21 in FIGS. 3A to 3C. The feeder circuits 30A and 30B are referred to simply as the feeder circuit 30 in FIGS. 3A to 3C.

As illustrated in FIG. 3A, the frequency stabilizing circuit 35 includes a primary circuit (first series circuit) 36 and a secondary circuit (second series circuit) 37. The primary series circuit 36 includes a first inductance element (first coil conductor) L1 and a second inductance element (second coil conductor) L2 connected in series to the first inductance element L1. The secondary series circuit 37 includes a third inductance element (third coil conductor) L3 and a fourth inductance element (fourth coil conductor) L4 connected in series to the third inductance element L3.

A first end of the primary series circuit 36 (first end of the first inductance element L1) is connected to the feeder circuit 30, and a first end of the secondary series circuit 37 (first end of the third inductance element L3) is connected to the first radiator 11. A second end of the primary series circuit 36 (second end of the second inductance element L2) and a second end of the secondary series circuit 37 (second end of the fourth inductance element L4) are connected to the second radiator 21.

As illustrated in FIG. 3B, the first inductance element L1 and the second inductance element L2 are coupled to each other in opposite phase, and the third inductance element L3 and the fourth inductance element L4 are coupled to each other in opposite phase. That is, the first inductance element and the second inductance element are wound so as to define a first closed magnetic circuit, the third inductance element and the fourth inductance element are wound so as to define a second closed magnetic circuit, and the first closed magnetic circuit and the second closed magnetic circuit are coupled to each other. The first inductance element L1 and the third inductance element L3 are coupled to each other in opposite phase, and the second inductance element L2 and the fourth inductance element L4 are coupled to each other in opposite phase. That is, the first inductance element L1 and the third inductance element L3 define a closed magnetic circuit, and the second inductance element L2 and the fourth inductance element L4 define a closed magnetic circuit.

For the frequency stabilizing circuit 35 having the above-described configuration, a high-frequency signal current from the feeder circuit 30 to the primary series circuit 36 is guided to the first inductance element L1, and is guided as a secondary current to the third inductance element L3 through an induction field. A high-frequency signal current guided to the second inductance element L2 is guided as a secondary current to the fourth inductance element L4 through an induction field. As a result, the high-frequency signal current flows in the directions indicated by the arrows illustrated in FIG. 3B.

That is, for the primary series circuit 36, because the first inductance element L1 and the second inductance element L2 are connected in series and in opposite phase, the passage of a current through the first inductance element L1 and the second inductance element L2 defines a closed magnetic circuit at the elements L1 and L2. Similarly, for the secondary series circuit 37, because the third inductance element L3 and the fourth inductance element L4 are connected in series and in opposite phase, when an induced current caused by the closed magnetic circuit provided at the primary series circuit 36 passes through the third inductance element L3 and the fourth inductance element L4, a closed magnetic circuit is provided at the elements L3 and L4.

Because the first inductance element L1 and the second inductance element L2 are coupled in opposite phase, the total inductance value of the primary series circuit 36 is smaller than the inductance value obtained by simply summing the inductance value of the first inductance element L1 and the inductance value of the second inductance element L2. In contrast, for the first inductance element L1 and the third inductance element L3, which are coupled together through mutual inductance, the mutual inductance value is equal to the inductance value obtained by summing the inductance value of the first inductance element L1 and the inductance value of the third inductance element L3. The same applies to the relationship between the second inductance element L2 and the fourth inductance element L4.

That is, the sum total of the values of mutual inductances generated between the primary series circuit 36 and the secondary series circuit 37 is viewed as being relatively larger than the inductance value of the primary series circuit 36 or that of the secondary series circuit 37, and thus the apparent degree of coupling between the primary series circuit 36 and the secondary series circuit 37 is high. That is, the magnetic fields in the primary series circuit 36 and the secondary series circuit 37 define their respective closed magnetic circuits, and a current (displacement current) passes through the secondary series circuit 37 in a direction that cancels the magnetic field occurring in the primary series circuit 36. Therefore, power does not virtually leak from each of the primary series circuit 36 and the secondary series circuit 37. Additionally, the degree of coupling between the primary series circuit 36 and the secondary series circuit 37 is high. As the degree of coupling between the primary series circuit 36 and the secondary series circuit 37, a high degree equal to or more than approximately 0.7, in particular, a significantly high degree of approximately 0.9 to 1.0, for example, is obtainable.

For the frequency stabilizing circuit 35, impedance matching with the feeder circuit 30 is performed mainly at the primary series circuit 36, and impedance matching with the first radiator 11 is performed mainly at the secondary series circuit 37. Accordingly, the impedance matching is easily achievable.

Figure 4A:
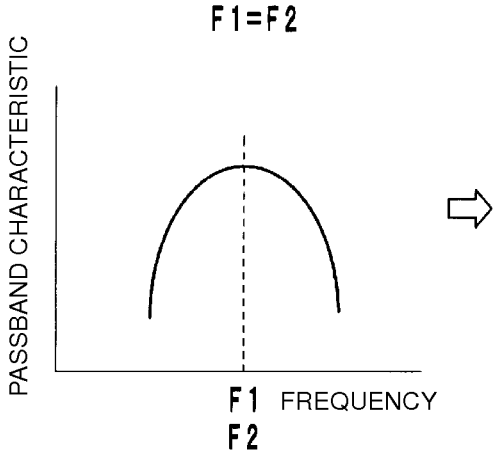
FIGS. 4A, 4B, 4C, and 4D illustrate passband characteristics of the frequency stabilizing circuit viewed from a feeder circuit.
Figure 4B:
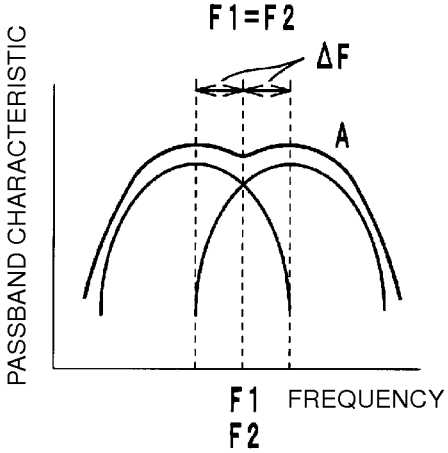

FIG. 3C illustrates the equivalent circuit illustrated in FIG. 3B represented from the viewpoint of being a filter. A capacitance element C1 is a line capacitance generated in the first and second inductance elements L1 and L2, and a capacitance element C2 is a line capacitance generated in the third and fourth inductance elements L3 and L4. A capacitance element C3 is a line capacitance (parasitic capacitance) generated in the primary series circuit 36 and the secondary series circuit 37. That is, an LC parallel resonant circuit R1 is defined at the primary series circuit 36, and an LC parallel resonant circuit R2 is defined at the secondary series circuit 37.

Where the resonant frequency of the LC parallel resonant circuit R1 is F1 and the resonant frequency of the LC parallel resonant circuit R2 is F2, when F1 is equal to F2, a high-frequency signal from the feeder circuit 30 exhibits the passband characteristic illustrated in FIG. 4A. The inductance value of each of the inductance elements L1 to L4 can be increased by coupling the first and second inductance elements L1 and L2 in opposite phase and coupling the third and fourth inductance elements L3 and L4 in opposite phase, so the wide passband characteristic is obtainable. For a high-frequency signal from the first radiator 11, the wide passband characteristic indicated by the curve A illustrated in FIG. 4B is obtainable. This mechanism is not completely clear, but one reason may be that degeneracy is removed because the LC parallel resonant circuits R1 and R2 are coupled together. ΔF is determined by the degree of coupling between the resonant circuits R1 and R2. The passband can be widened approximately proportionately with the degree of coupling.

Figure 4C:
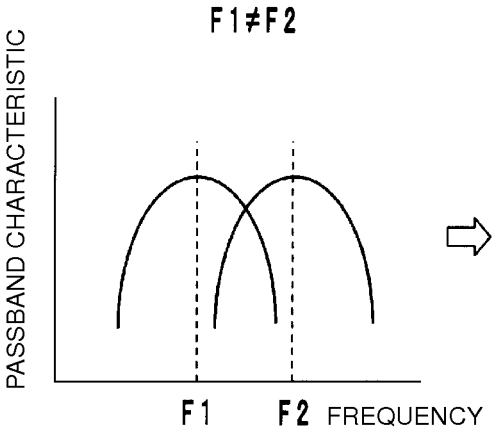
Figure 4D:
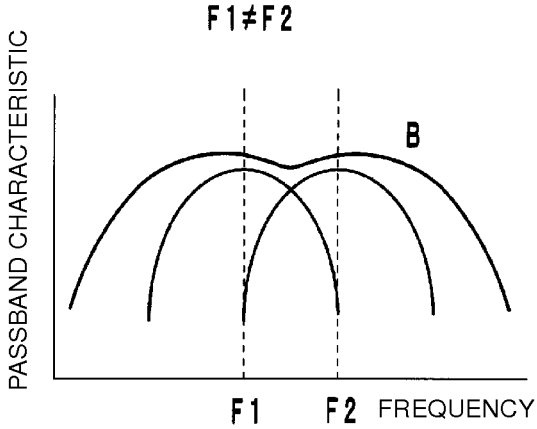

A high-frequency signal from the feeder circuit 30 when F1 is not equal to F2 exhibits the passband characteristic illustrated in FIG. 4C. For a high-frequency signal from the first radiator 11, the wide passband characteristic indicated by the curve B illustrated in FIG. 4D is obtainable. One reason may also be that degeneracy is removed because the LC parallel resonant circuits R1 and R2 are coupled together. An increase in the degree of coupling between the resonant circuits R1 and R2 leads to a wide passband characteristic.

In this manner, because the frequency characteristic is determined by resonance of the frequency stabilizing circuit 35, the frequency is not easily displaced. In addition, a wide passband characteristic ensures a sufficient passband even if the impedance slightly changes. That is, the frequency of high-frequency signals transmitted and received can be stabilized, independently of the shape of the radiator or the environment for the radiator.

Figure 5A:
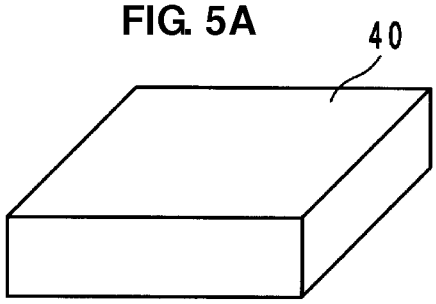
FIG. 5A is a perspective view of the frequency stabilizing circuit configured as a chip-type laminate.
Figure 5B:
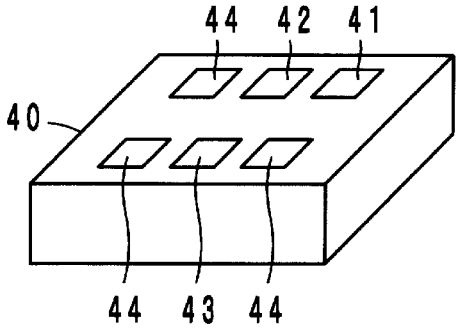
FIG. 5B is a perspective view of the back side thereof.

FIG. 5A is a perspective view of the frequency stabilizing circuit 35 configured as a chip-type laminate 40, and FIG. 5B is a perspective view of the back side thereof. The laminate 40 is one in which a plurality of dielectric or magnetic base layers are stacked. A feeding terminal 41 to be connected to the feeder circuit 30, a ground terminal 42 to be connected to the second radiator 21, and an antenna terminal 43 to be connected to the first radiator 11 are disposed on the back side of the laminate 40. Furthermore, non-connection (NC) terminals for use in implementation are also disposed thereon. If desired, an inductor or capacitor for use in impedance matching may also be mounted on a surface of the laminate 40. An inductor or capacitor may be defined by an electrode pattern in the laminate 40.

Figure 6:
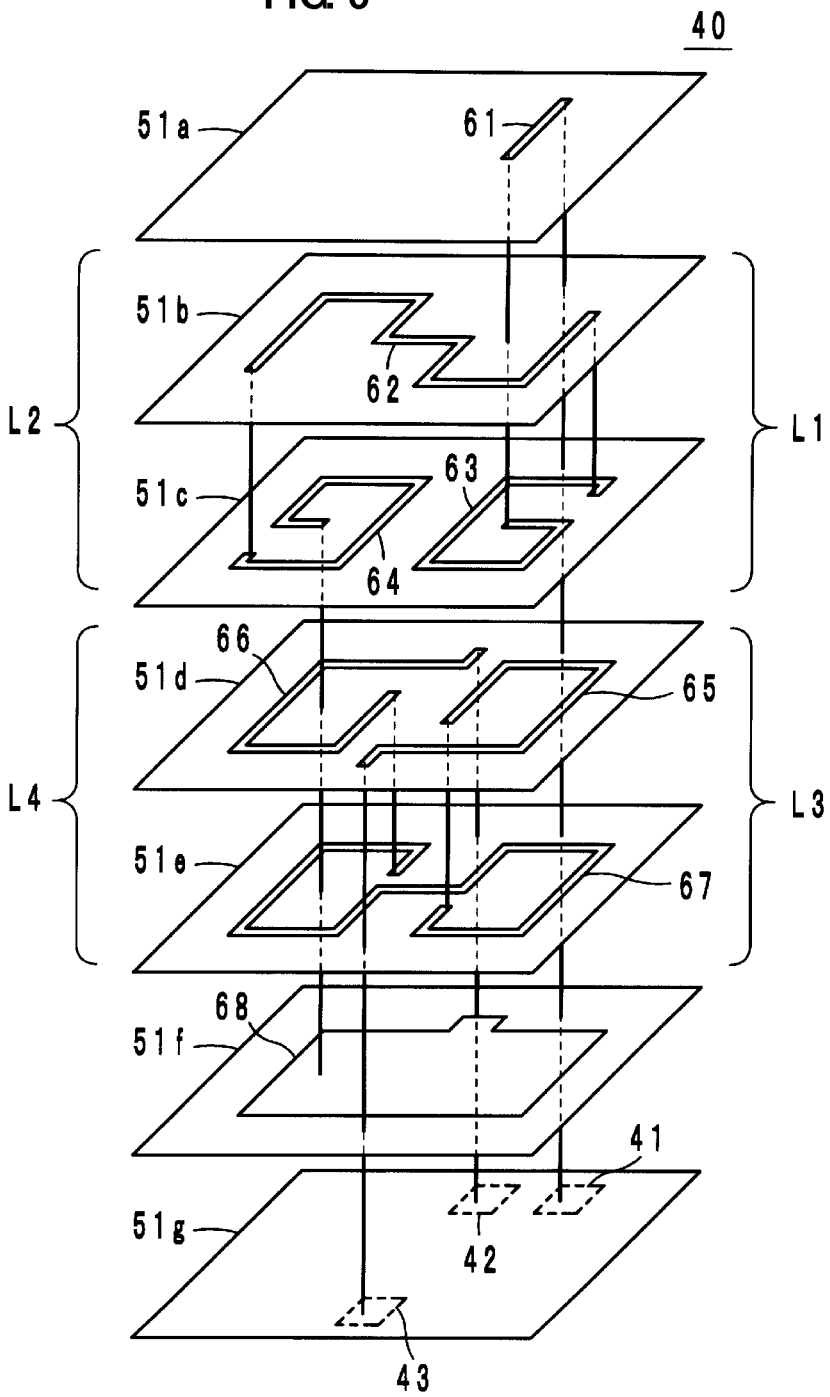
FIG. 6 is an exploded perspective view of the frequency stabilizing circuit.

FIG. 6 is an exploded perspective view of the frequency stabilizing circuit 35. This frequency stabilizing circuit is incorporated (configured) in the laminate 40. A conductive pattern 61 is disposed on an uppermost base layer 51*a*, a conductive pattern 62 defining the first and second inductance elements L1 and L2 is disposed on a second base layer 51*b*, and two conductive patterns 63 and 64 defining the first and second inductance elements L1 and L2 are disposed on a third base layer 51*c*. Two conductive patterns 65 and 66 defining the third and fourth inductance elements L3 and L4 are disposed on a fourth base layer 51*d*, and a conductive pattern 67 defining the third and fourth inductance elements L3 and L4 is disposed on a fifth base layer 51*e*. In addition, a ground conductive pattern 68 is disposed on a sixth base layer 51*f*, and the feeding terminal 41, the ground terminal 42, and the antenna terminal 43 are disposed on the back side of a seventh base layer 51*g*. The uppermost base layer 51*a* is overlaid with an unpatterned base layer (not illustrated).

The chief ingredient of the conductive patterns 61 to 68 can be a conductive material, such as silver or copper. The base layers 51*a* to 51*g* can be made of a dielectric material or a magnetic material. Examples of the dielectric material can include a glass ceramic material and an epoxy resin material. Examples of the magnetic material can include a ferrite ceramic material and a resin material containing ferrite.

The base layers 51*a* to 51*g* are stacked, thus connecting the conductive patterns 61 to 68 and the terminals 41, 42, and 43 together with via electrodes (interlayer connective conductors) so as to provide the equivalent circuit illustrated in FIG. 3A.

Incorporating the inductance elements L1 to L4 in the laminate 40, which is made of a dielectric or magnetic material, in particular, disposing the portion where the primary series circuit 36 and the secondary series circuit 37 are coupled together inside the laminate 40 makes the frequency stabilizing circuit 35 resistant to the effects of other circuit elements or circuit patterns arranged adjacent to the laminate 40. As a result, the frequency characteristic can be further stabilized.

A printed wiring board (not illustrated) on which the laminate 40 is mounted is provided with various types of wiring, which may interfere with the frequency stabilizing circuit 35. Such an interference between the inductance elements and various types of wiring on the printed wiring board can be suppressed by the ground conductive pattern 68 disposed on the bottom of the laminate 40 so as to cover the openings of the coils formed by the conductive patterns 61 to 67, as in the present preferred embodiment. In other words, variations in the L values of the inductance elements L1 to L4 are reduced.

Figure 7:
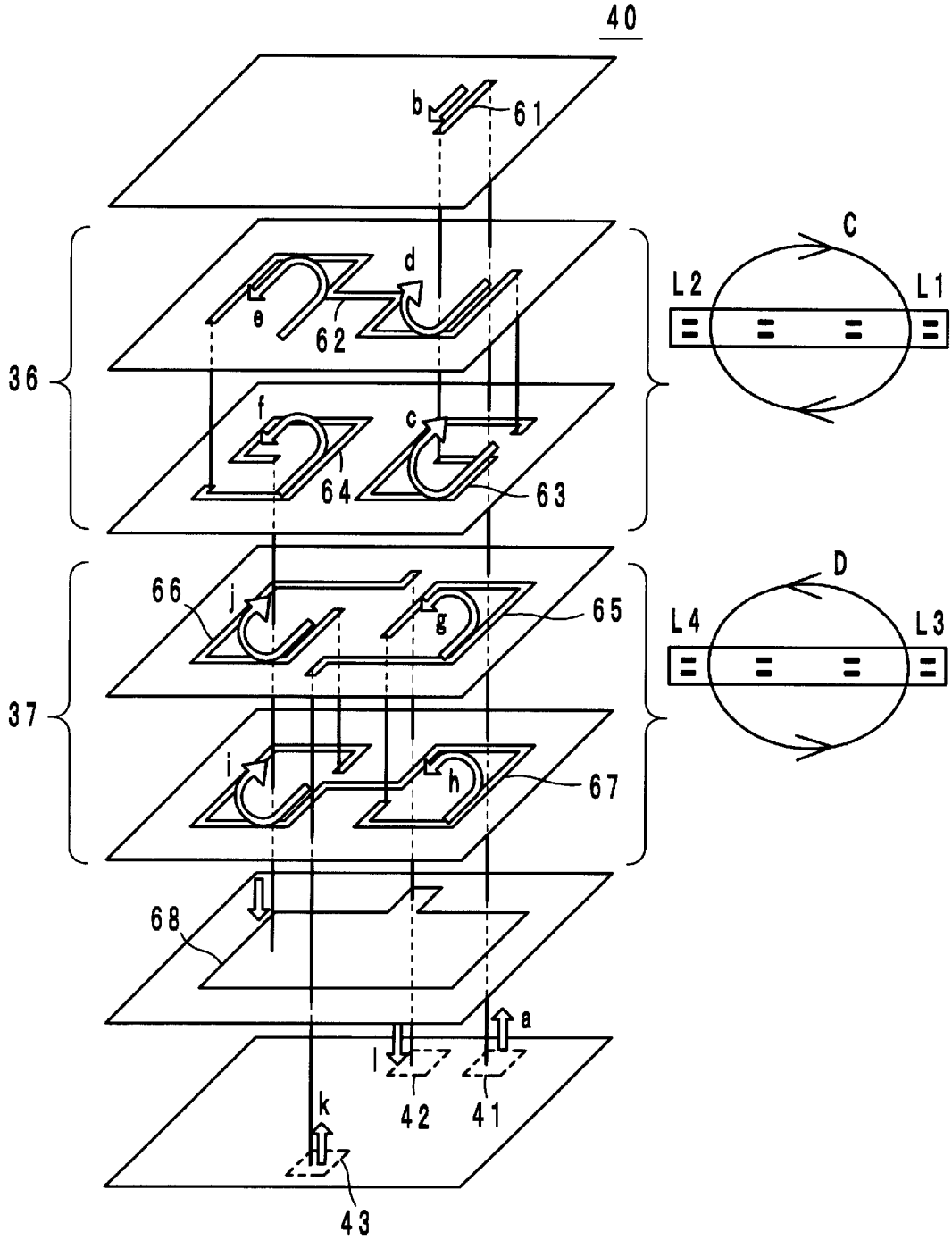
FIG. 7 illustrates a current passing through conductive patterns in the laminate of the frequency stabilizing circuit.

As illustrated in FIG. 7, for the frequency stabilizing circuit 35, a high-frequency signal current input from the feeding terminal 41 flows as indicated by the arrows a and b, is guided to the first inductance element L1 (conductive patterns 62 and 63) as indicated by the arrows c and d, and then is guided to the second inductance element L2 (conductive patterns 62 and 64) as indicated by the arrows e and f. A magnetic field C caused by the primary current (arrows c and d) excites a high-frequency signal current as indicated by the arrows g and h in the third inductance element L3 (conductive patterns 65 and 67), and an induced current (secondary current) flows. Similarly, the magnetic field C caused by the primary current (arrows e and f) excites a high-frequency signal current as indicated by the arrows i and j in the fourth inductance element L4 (conductive patterns 66 and 67), and an induced current (secondary current) flows. As a result, a high-frequency signal current indicated by the arrow k flows through the antenna terminal 43, and a high-frequency signal current indicated by the arrow 1 flows through the ground terminal 42. If a current flowing through the feeding terminal 41 (arrow a) is in the opposite direction, other currents also flow in the opposite direction.

For the primary series circuit 36, the first and second inductance elements L1 and L2 are coupled to each other in opposite phase. For the secondary series circuit 37, the third and fourth inductance elements L3 and L4 are coupled to each other in opposite phase. Both define their respective closed magnetic circuits. Accordingly, loss of energy can be reduced. When the inductance value of the first and second inductance elements L1 and L2 and the inductance value of the third and fourth inductance elements L3 and L4 are substantially the same, leakage of a magnetic field from the closed magnetic circuits can be reduced and loss of energy can be further reduced.

The magnetic field C excited by the primary current in the primary series circuit 36 and a magnetic field D excited by the secondary current in the secondary series circuit 37 occur so as to cancel each other out by the induced currents. The use of the induced currents reduces loss of energy and leads to a high degree of coupling between the first inductance element L1 and the third inductance element L3 and that between the second inductance element L2 and the fourth inductance element L4. That is, the primary series circuit 36 and the secondary series circuit 37 are coupled together with a high degree of coupling.

The frequency stabilizing circuits 35A and 35B illustrated in FIGS. 1 and 2, which have the above-described configuration, can achieve the functions of (1) setting a center frequency, (2) setting a passband, and (3) matching with a feeder circuit, even when the first antenna element 11A and the second antenna element 11B are adjacent to each other, as illustrated in FIGS. 1 and 2. Accordingly, the first antenna element 11A and the second antenna element 11B are simply required to be designed so as to mainly perform the functions of (4) setting a directivity and (5) ensuring a gain, from among the antenna characteristics. Therefore, the antenna device allowing greater design flexibility in, for example, the arrangement of a plurality of antenna elements and the shape and size of each antenna element and having a simple configuration that does not necessarily have to include an isolation element can be achieved. The unnecessity of an isolation element between the antenna elements can result in a small communication terminal apparatus.

Second Preferred Embodiment

Figure 8:
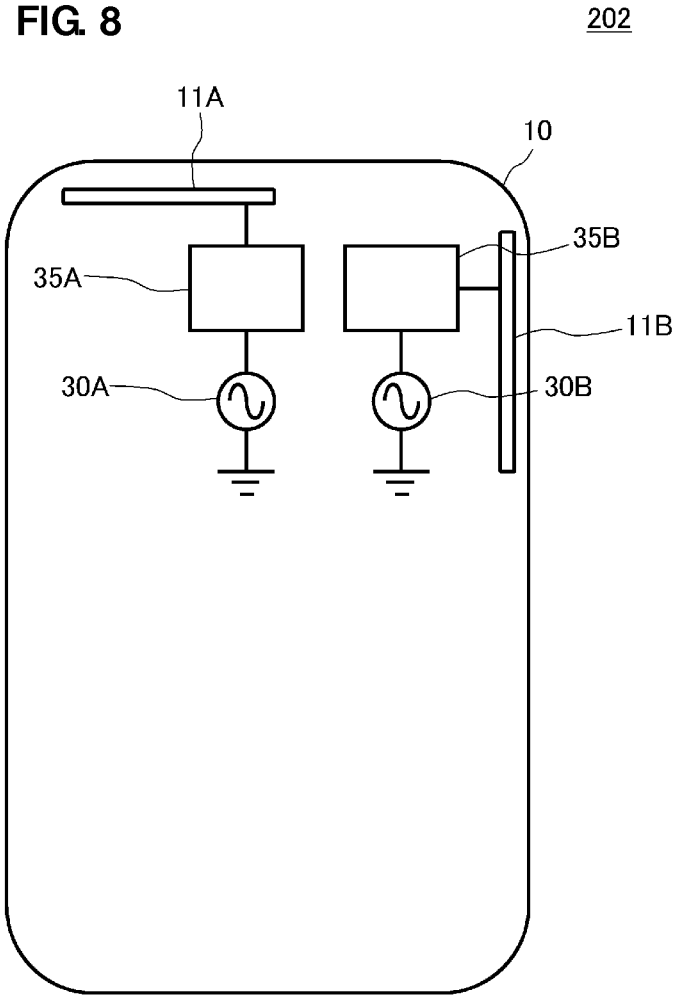
FIG. 8 illustrates a configuration of a communication terminal apparatus according to a second preferred embodiment of the present invention.

FIG. 8 illustrates a configuration of a communication terminal apparatus 202 according to a second preferred embodiment. The communication terminal apparatus 202 includes the first antenna element 11A, second antenna element 11B, first frequency stabilizing circuit 35A connected to the feeding end of the first antenna element 11A, and second frequency stabilizing circuit 35B connected to the feeding end of the second antenna element 11B.

The two frequency stabilizing circuits 35A and 35B in the example illustrated in FIG. 8 are adjacent to each other, in contrast to the example illustrated in FIG. 2, in which the two antenna elements 11A and 11B are adjacent to each other. The configuration and the operation and effect of the frequency stabilizing circuits 35A and 35B are described above. Accordingly, even when the two frequency stabilizing circuits 35A and 35B are adjacent to each other, virtually no interference occurs between them. Thus, the frequency stabilizing circuits 35A and 35B can perform the functions of (1) setting a center frequency, (2) setting a passband, and (3) matching with a feeder circuit of the antenna elements 11A and 11B.

Third Preferred Embodiment

Figure 9:
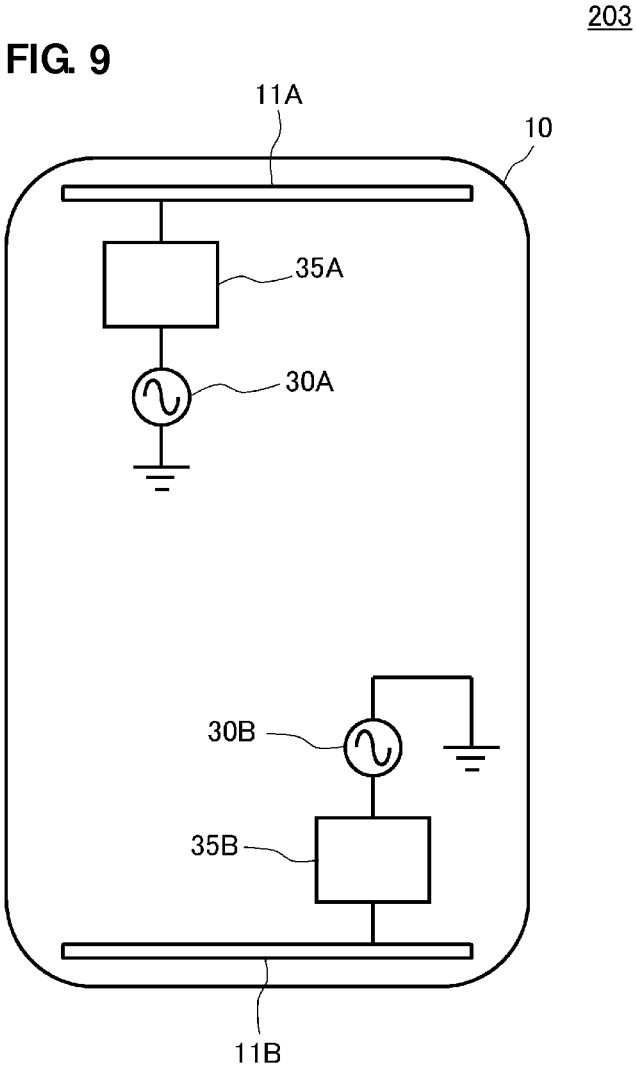
FIG. 9 illustrates a configuration of a communication terminal apparatus according to a third preferred embodiment of the present invention.

FIG. 9 illustrates a configuration of a communication terminal apparatus 203 according to a third preferred embodiment. The communication terminal apparatus 203 includes the first antenna element 11A, second antenna element 11B, first frequency stabilizing circuit 35A connected to the feeding end of the first antenna element 11A, and second frequency stabilizing circuit 35B connected to the feeding end of the second antenna element 11B.

The first antenna element 11A and the second antenna element 11B are arranged along two opposite sides of the case 10. Because the two antenna elements 11A and 11B are significantly remote from each other, this configuration is effective, especially for an antenna diversity configuration.

Fourth Preferred Embodiment

Figure 10:
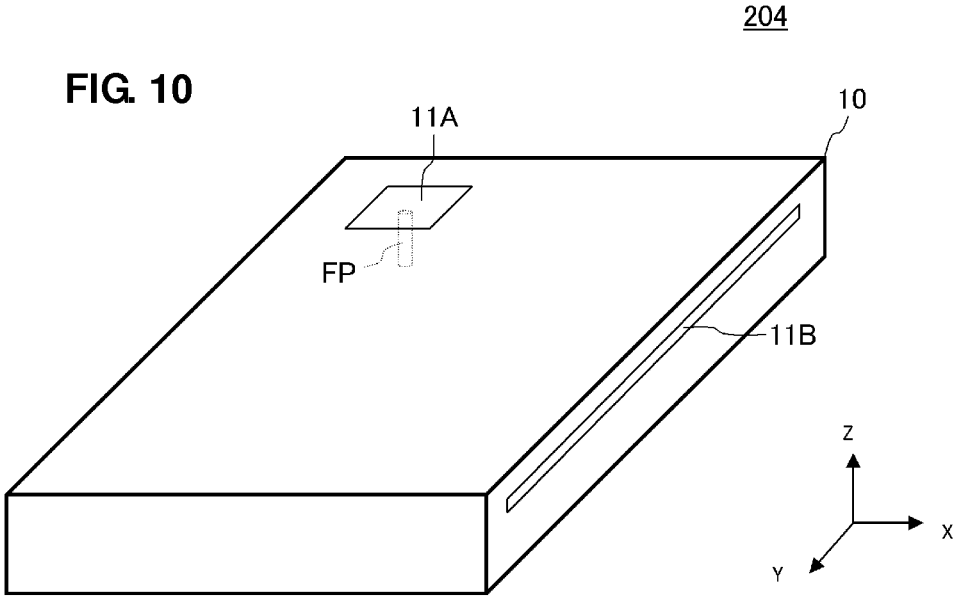
FIG. 10 illustrates a configuration of a communication terminal apparatus according to a fourth preferred embodiment of the present invention.

FIG. 10 illustrates a configuration of a communication terminal apparatus 204 according to a fourth preferred embodiment. For the communication terminal apparatus 204, the first antenna element 11A is arranged along a first principal surface of the case 10, and the second antenna element 11B is arranged along a first side surface of the case 10. The first antenna element 11A is a patch antenna, and the feeder circuit is connected to a feeding end FP of the patch antenna. The second antenna element 11B is an antenna including a line emitting electrode (monopole antenna).

With this configuration, the first antenna element 11A has directivity of a substantially hemispherical pattern that faces the z-axis direction, and the second antenna element 11B has directivity of a torus pattern having the y-axis as an axis of symmetry.

As described above, the two antenna elements may have different directivity patterns and different orientations thereof.

Fifth Preferred Embodiment

Figure 11:
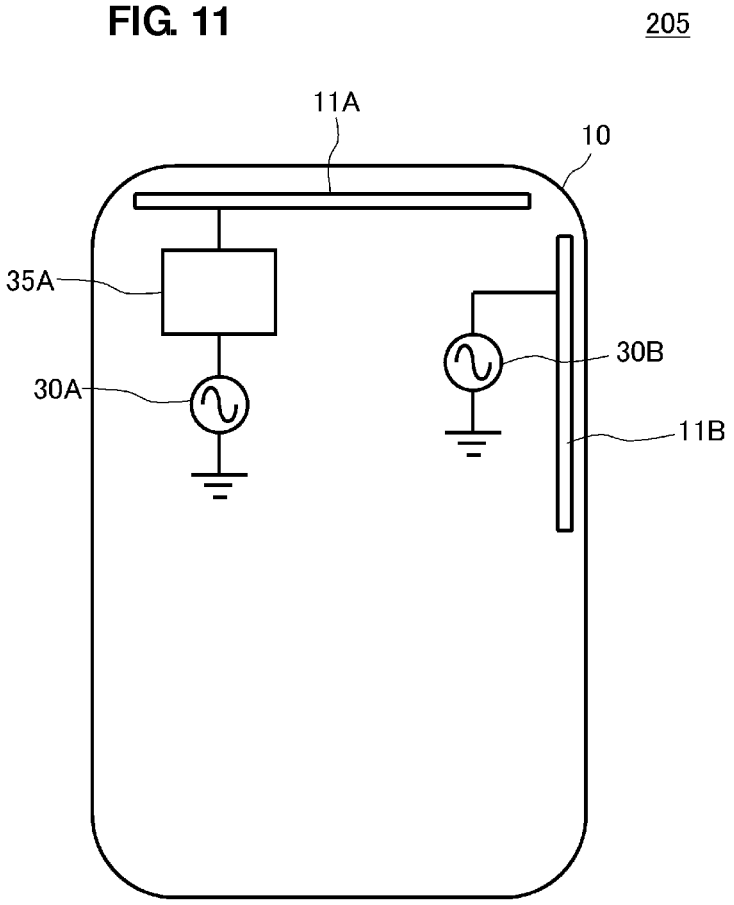
FIG. 11 illustrates a configuration of a communication terminal apparatus according to a fifth preferred embodiment of the present invention.

FIG. 11 illustrates a configuration of a communication terminal apparatus 205 according to a fifth preferred embodiment. The communication terminal apparatus 205 includes the first antenna element 11A, second antenna element 11B, first frequency stabilizing circuit 35A connected to the feeding end of the first antenna element 11A, and feeder circuits 30A and 30B.

For the example illustrated in FIG. 11, only the frequency stabilizing circuit 35A is disposed between the first antenna element 11A and the feeder circuit 30A and the second antenna element 11B is directly connected to the feeder circuit 30B, in contrast to the first to fourth preferred embodiments, in which a frequency stabilizing circuit is disposed between each of the two antenna elements 11A and 11B and a corresponding feeder circuit. The configuration and the operation and effect of the frequency stabilizing circuit 35A are described above in the foregoing preferred embodiments.

In this manner, not all antenna elements are provided with frequency stabilizing circuits. For example, in the case where the second antenna element 11B does not receive much interference from the first antenna element 11A or in the case where, even if it receives interference, that is not an issue in terms of the antenna characteristics, the second antenna element 11B does not need a frequency stabilizing circuit. In contrast, in the case where the first antenna element 11A receives interference from the second antenna element 11B, the first antenna element 11A can be provided with the frequency stabilizing circuit 35A.

Sixth Preferred Embodiment

Figure 12:
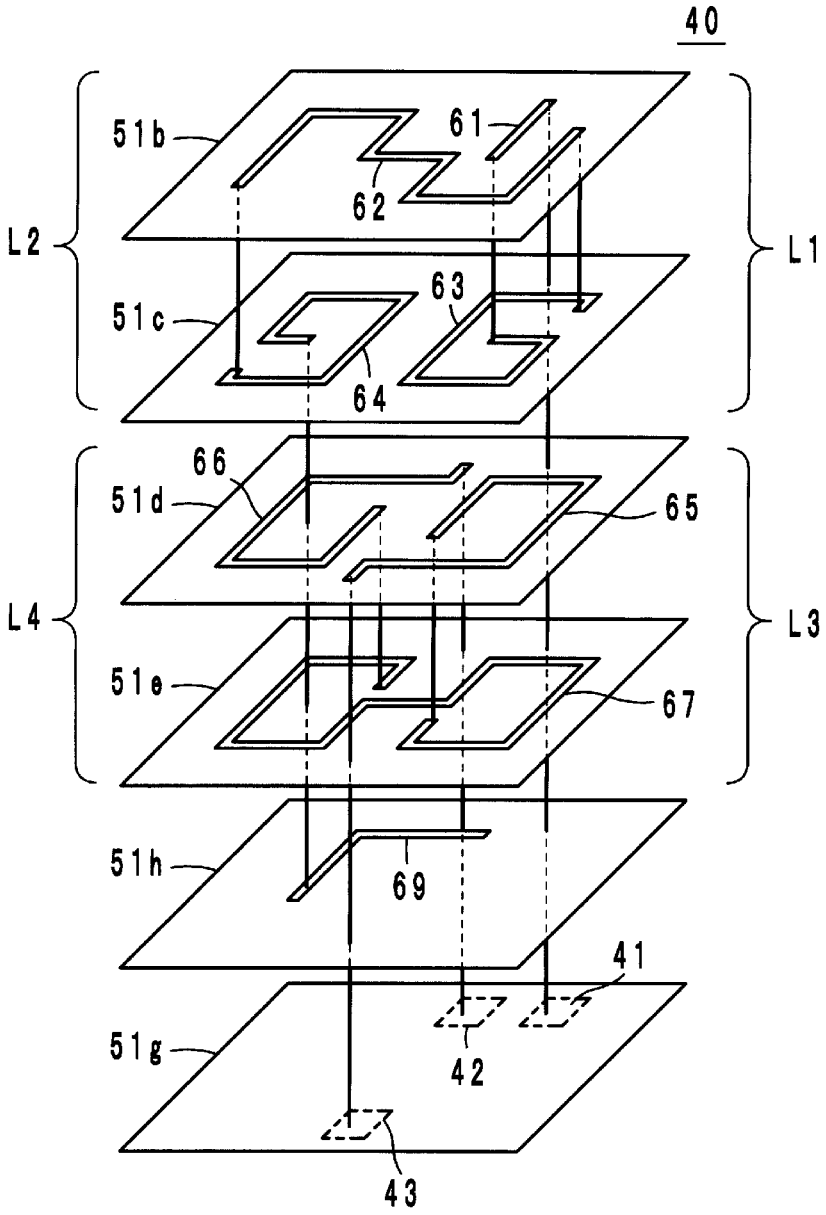
FIG. 12 is an exploded perspective view of a frequency stabilizing circuit included in an antenna device according to a sixth preferred embodiment of the present invention.

A sixth preferred embodiment illustrates another example of a frequency stabilizing circuit. FIG. 12 is an exploded perspective view of a frequency stabilizing circuit included in an antenna device according to the sixth preferred embodiment. The frequency stabilizing circuit has substantially the same configuration as in the example illustrated in FIG. 6, but differs in that the base layer 51*a* is omitted, the conductive pattern 61 is disposed on the base layer 51*b*, the ground conductive pattern 68 is omitted, and a connective conductive pattern 69 is disposed on a base layer 51*h*. For the example illustrated in FIG. 12, because the ground conductive pattern (68 in FIG. 6) is omitted, a printed wiring board on which the laminate 40 is mounted may preferably include a conductor corresponding to the ground conductive pattern 68.

Seventh Preferred Embodiment

Figure 13:
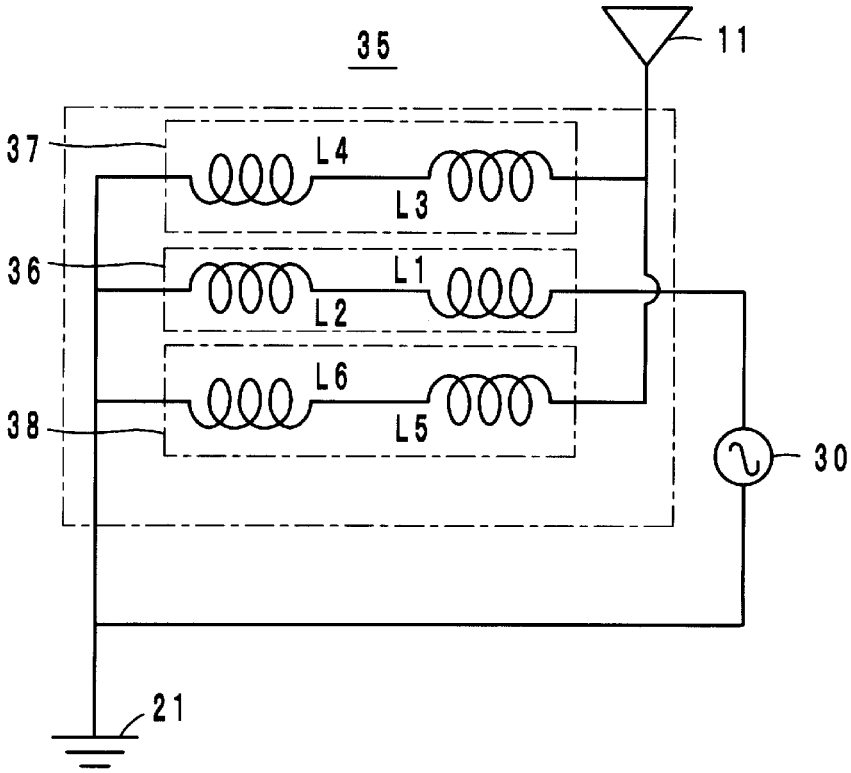
FIG. 13 is a circuit diagram of a frequency stabilizing circuit included in an antenna device according to a seventh preferred embodiment of the present invention.

FIG. 13 is a circuit diagram of a frequency stabilizing circuit included in an antenna device according to a seventh preferred embodiment. The frequency stabilizing circuit 35 illustrated in FIG. 13 includes a secondary series circuit 38 (secondary reactance circuit), in addition to the primary series circuit 36 and the secondary series circuit 37 illustrated in FIG. 3A. A fifth inductance element L5 and a sixth inductance element L6 defining the secondary series circuit 38 are coupled to each other in opposite phase. The fifth inductance element L5 is coupled to the first inductance element L1 in opposite phase. The sixth inductance element L6 is coupled to the second inductance element L2 in opposite phase. The fifth inductance element L5 includes a first end connected to the first radiator 11. The sixth inductance element L6 includes a first end connected to the second radiator 21.

Figure 14:
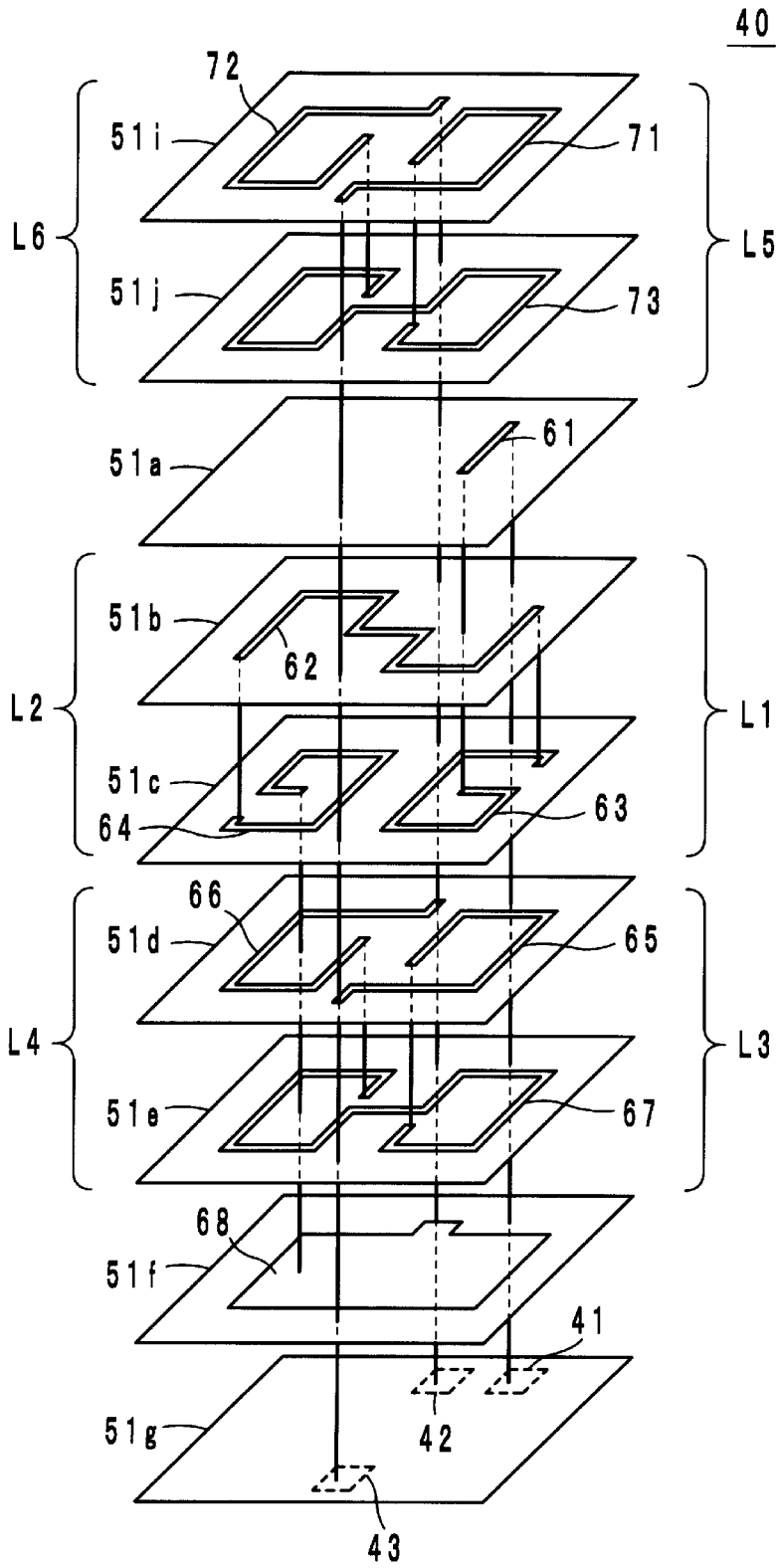
FIG. 14 is an exploded perspective view of the frequency stabilizing circuit.

FIG. 14 is an exploded perspective view of the frequency stabilizing circuit. The frequency stabilizing circuit is incorporated (configured) in the laminate 40. For this example, base layers 51*i* and 51*j* on which conductive patterns 71, 72, and 73 defining the fifth inductance element L5 and the sixth inductance element L6 of the secondary series circuit 38 are disposed are stacked on the laminate illustrated in FIG. 6.

The basic operation of the frequency stabilizing circuit according to the seventh preferred embodiment is substantially the same as that illustrated in the first preferred embodiment. For the seventh preferred embodiment, sandwiching the primary series circuit 36 between the two secondary series circuits 37 and 38 reduces loss of energy in transmission of a high-frequency signal from the primary series circuit 36 to the secondary series circuits 37 and 38.

Eighth Preferred Embodiment

Figure 15:
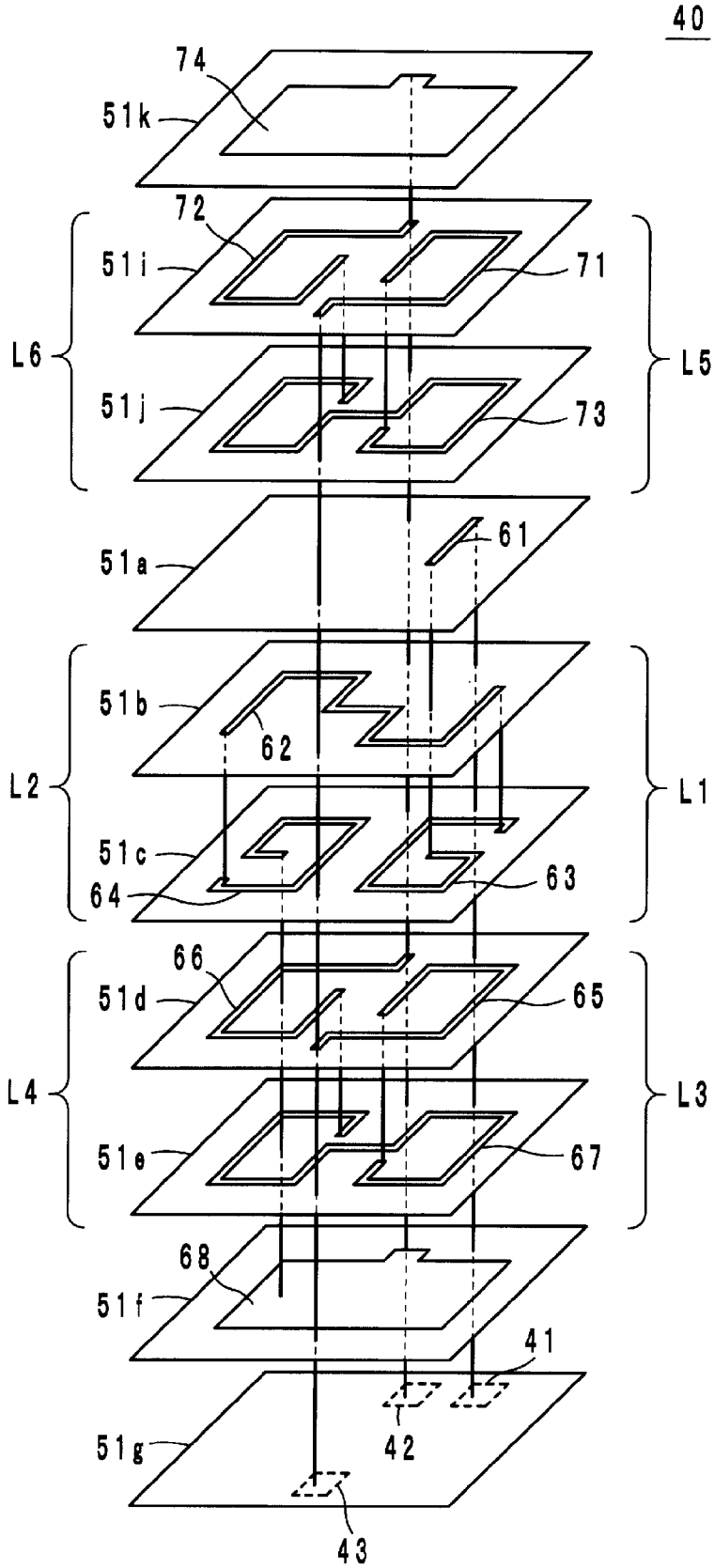
FIG. 15 is an exploded perspective view of a frequency stabilizing circuit included in an antenna device according to an eighth preferred embodiment of the present invention.

FIG. 15 is an exploded perspective view of a frequency stabilizing circuit included in an antenna device according to an eighth preferred embodiment. The frequency stabilizing circuit is one in which a base layer 51*k* on which a ground conductive pattern 74 is disposed is stacked on the laminate illustrated in FIG. 14 for the seventh preferred embodiment. The ground conductive pattern 74 is arranged to cover the openings of the coils defined by the conductive patterns 71, 72, and 73, as in the case of the ground conductor 68 on the bottom. Accordingly, for this example, the ground conductive pattern 74 can suppress interference between the inductance elements and various types of wiring directly above the laminate 40.

Ninth Preferred Embodiment

Figure 16:
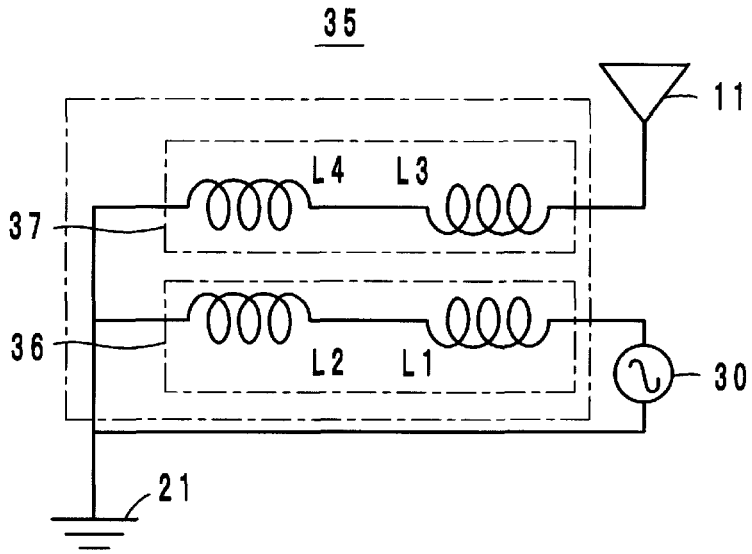
FIG. 16 is a circuit diagram of a frequency stabilizing circuit included in an antenna device according to a ninth preferred embodiment of the present invention.

FIG. 16 is a circuit diagram of a frequency stabilizing circuit included in an antenna device according to a ninth preferred embodiment. The frequency stabilizing circuit 35 used here is basically the same as that in the first preferred embodiment, but differs in that the first inductance element L1 and the third inductance element L3 are coupled to each other in phase and the second inductance element L2 and the fourth inductance element L4 are coupled to each other in phase. That is, the first inductance element L1 and the third inductance element L3 are coupled mainly through a magnetic field, and the second inductance element L2 and the fourth inductance element L4 are coupled mainly through a magnetic field. The operation and effect of this frequency stabilizing circuit are basically the same as those of the frequency stabilizing circuit illustrated in the first preferred embodiment.

Tenth Preferred Embodiment

Figure 17:
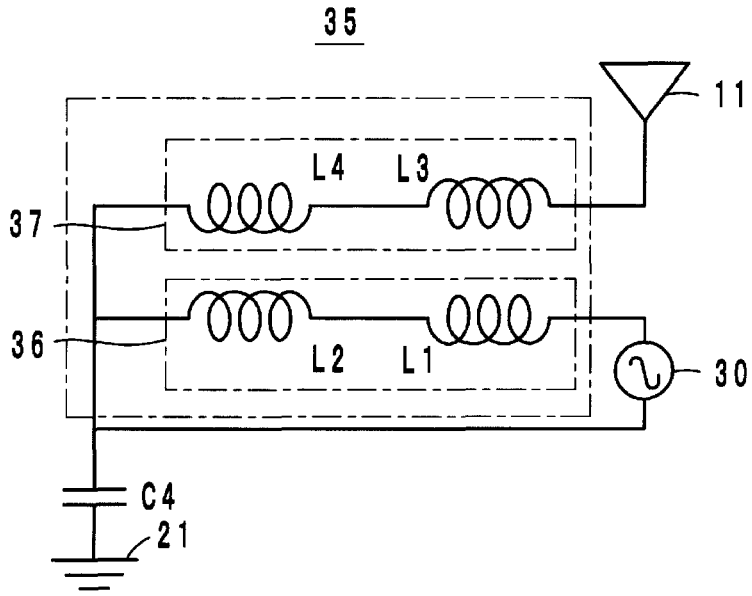
FIG. 17 is a circuit diagram of a frequency stabilizing circuit included in an antenna device according to a tenth preferred embodiment of the present invention.

FIG. 17 is a circuit diagram of a frequency stabilizing circuit included in an antenna device according to a tenth preferred embodiment. The frequency stabilizing circuit 35 used here is basically the same as that in the first preferred embodiment, but differs in that a capacitance element C4 is disposed between the frequency stabilizing circuit 35 and the second radiator 21. The capacitance element C4 functions as one for cutting a bias to cut a direct component and a low-frequency component and also functions as an electrostatic discharge (ESD) protection element.

Eleventh Preferred Embodiment

Figure 18:
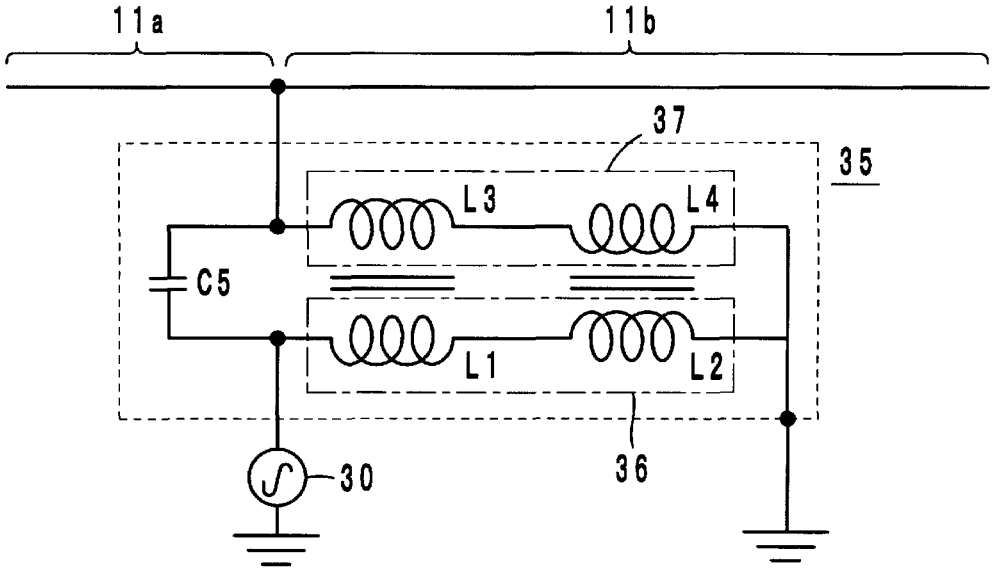
FIG. 18 illustrates a configuration of an antenna device according to an eleventh preferred embodiment of the present invention.

FIG. 18 illustrates a configuration of an antenna device according to an eleventh preferred embodiment. The antenna device is used in a multi-band supporting mobile wireless communication system (for 800 MHz band, 900 MHz band, 1800 MHz band, 1900 MHz band) capable of supporting Global System for Mobile Communications (GSM) and Code division multiple access (CDMA). The frequency stabilizing circuit 35 used here is one in which a capacitance element C5 is disposed between the primary series circuit 36 and the secondary series circuit 37. The other configuration is substantially the same as in the first preferred embodiment, and the operation and effect are basically the same as in the first preferred embodiment. As the radiator, branch monopole antenna units 11*a* and 11*b* are disposed.

The antenna device can be used as a main antenna of a communication terminal apparatus. Of the branch monopole antenna units 11*a* and 11*b*, the antenna unit 11*a* mainly functions as an antenna radiator for use in high bands (1800 MHz to 2400 MHz band) and the antenna unit 11*b* mainly functions as an antenna radiator for use in low bands (800 MHz to 900 MHz band). The branch monopole antenna units 11*a* and 11*b* do not necessarily resonate as an antenna in their respective supporting frequency bands. This is because the frequency stabilizing circuit 35 matches the characteristic impedance of the antenna units 11*a* and 11*b* with the impedance of the RF circuit. For example, the frequency stabilizing circuit 35 matches the characteristic impedance of the antenna unit 11*b* with the impedance of the RF circuit (typically approximately 50Ω) in the 800 MHz to 900 MHz band. This enables the antenna unit 11*b* to transmit a signal from the RF circuit or the antenna unit 11*b* to receive a signal for the RF circuit.

In such a way, in the case where impedance is matched in a plurality of significantly remote frequency bands, the impedance matching can be achieved in each frequency band by, for example, the use of the plurality of frequency stabilizing circuits 35 arranged in parallel. Alternatively, the impedance matching can be achieved in each frequency band by the use of a plurality of secondary series circuits 37 coupled to the primary series circuit 36.

Twelfth Preferred Embodiment

Figure 19:
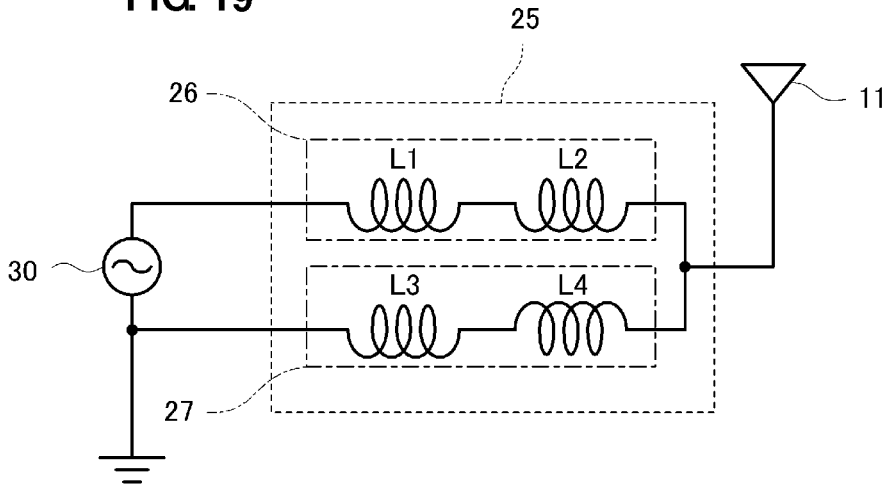
FIG. 19 is a circuit diagram of a frequency stabilizing circuit according to a twelfth preferred embodiment of the present invention.

FIG. 19 is a circuit diagram of a frequency stabilizing circuit 25 according to a 12th preferred embodiment. The frequency stabilizing circuit 25 includes a first series circuit 26 connected to the feeder circuit 30 and a second series circuit 27 electromagnetically coupled to the first series circuit 26. The first series circuit 26 is a series circuit of the first inductance element L1 and the second inductance element L2. The second series circuit 27 is a series circuit of the third inductance element L3 and the fourth inductance element L4. The first series circuit 26 is connected between the antenna port and the feeding port. The second series circuit 27 is connected between the antenna port and the ground.

Figure 20:
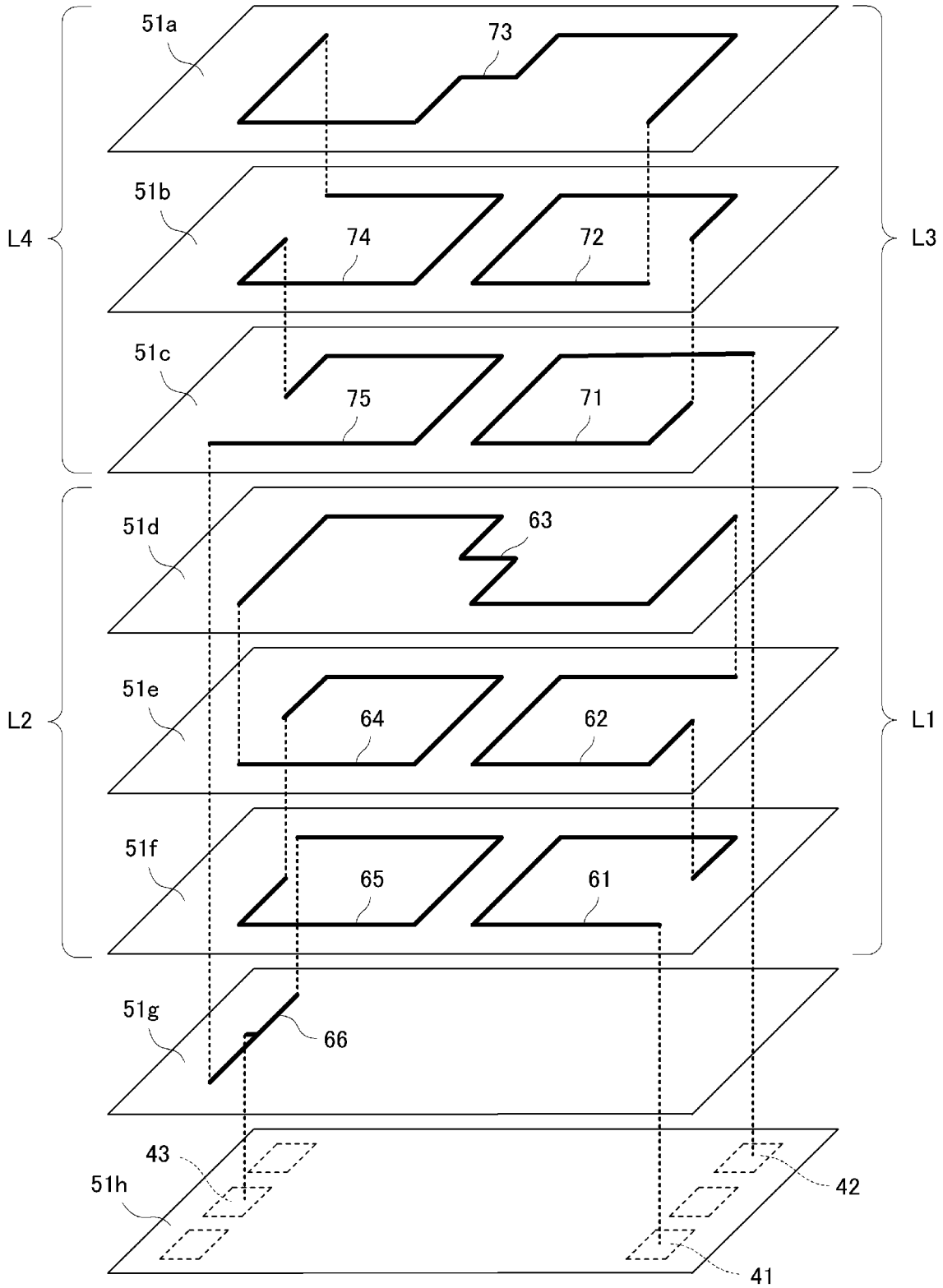
FIG. 20 illustrates an example of a conductive pattern on each layer in the case where the frequency stabilizing circuit according to the twelfth preferred embodiment is configured in a multilayer substrate of the present invention.

FIG. 20 illustrates an example of a conductive pattern on each layer in the case where the frequency stabilizing circuit 25 according to the 12th preferred embodiment is configured in a multilayer substrate. Each of the layers includes a magnetic sheet on which the conductive pattern is disposed. The line conductive pattern has a predetermined line width, but it is represented by a simple solid line. The uppermost layer 51*a* is overlaid with an unpatterned base layer (not illustrated).

The conductive pattern 73 is disposed on the first layer 51*a* in the range illustrated in FIG. 20, the conductive patterns 72 and 74 are disposed on the second layer 51*b*, and the conductive patterns 71 and 75 are disposed on the third layer 51*c*. The conductive pattern 63 is disposed on the fourth layer 51*d*, the conductive patterns 62 and 64 are disposed on the fifth layer 51*e*, and the conductive patterns 61 and 65 are disposed on the sixth layer 51*f*. The conductive pattern 66 is disposed on the seventh layer 51*g*, and the feeding terminal 41, ground terminal 42, and antenna terminal 43 are disposed on the back side of the eighth layer 51*h*. In FIG. 20, the vertically extending broken lines indicate via electrodes that connect the conductive patterns between the layers. Actually, each of the via electrodes is an electrode having a substantially cylindrical shape with a predetermined diameter dimension, but it is represented by a simple broken line.

In FIG. 20, the conductive patterns 61 and 62 and the right half of the conductive pattern 63 define the first inductance element L1. The conductive patterns 64 and 65 and the left half of the conductive pattern 63 define the second inductance element L2. The conductive patterns 71 and 72 and the right half of the conductive pattern 73 define the third inductance element L3. The conductive patterns 74 and 75 and the left half of the conductive pattern 73 define the fourth inductance element L4. The winding axis of each of the inductance elements L1 to L4 faces the direction in which the layers of the multilayer substrate are stacked. The first inductance element L1 and the second inductance element L2 are arranged adjacent to each other such that their respective winding axes are in a different relationship. Similarly, the third inductance element L3 and the fourth inductance element L4 are arranged adjacent to each other such that their respective winding axes are in a different relationship. The winding range of the first inductance element L1 and that of the third inductance element L3 coincide with each another at least partially in plan view. The winding range of the second inductance element L2 and that of the fourth inductance element L4 coincide with each other at least partially in plan view. For this example, they coincide substantially wholly. In this manner, the conductive patterns having the shape of a figure eight define the four inductance elements.

Each layer may include a dielectric sheet. If a layer includes a magnetic sheet having a high relative permeability, the coefficient of coupling between the inductance elements can be further increased.

Figure 21:
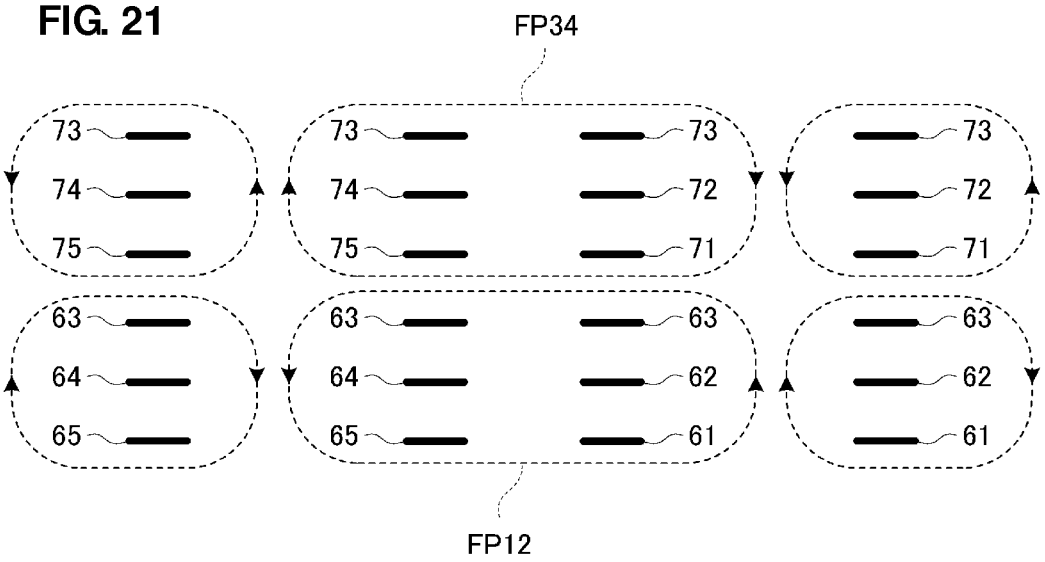
FIG. 21 illustrates main magnetic flux that passes through inductance elements defined by the conductive patterns on the layers of the multilayer substrate illustrated in FIG. 20.

FIG. 21 illustrates main magnetic flux passing through the inductance elements defined by the conductive patterns on the layers of the multilayer substrate illustrated in FIG. 20. Magnetic flux FP12 passes through the first inductance element L1 defined by the conductive patterns 61 to 63 and the second inductance element L2 defined by the conductive patterns 63 to 65. Magnetic flux FP34 passes through the third inductance element L3 defined by the conductive patterns 71 to 73 and the fourth inductance element L4 defined by the conductive patterns 73 to 75.

Thirteenth Preferred Embodiment

Figure 22:
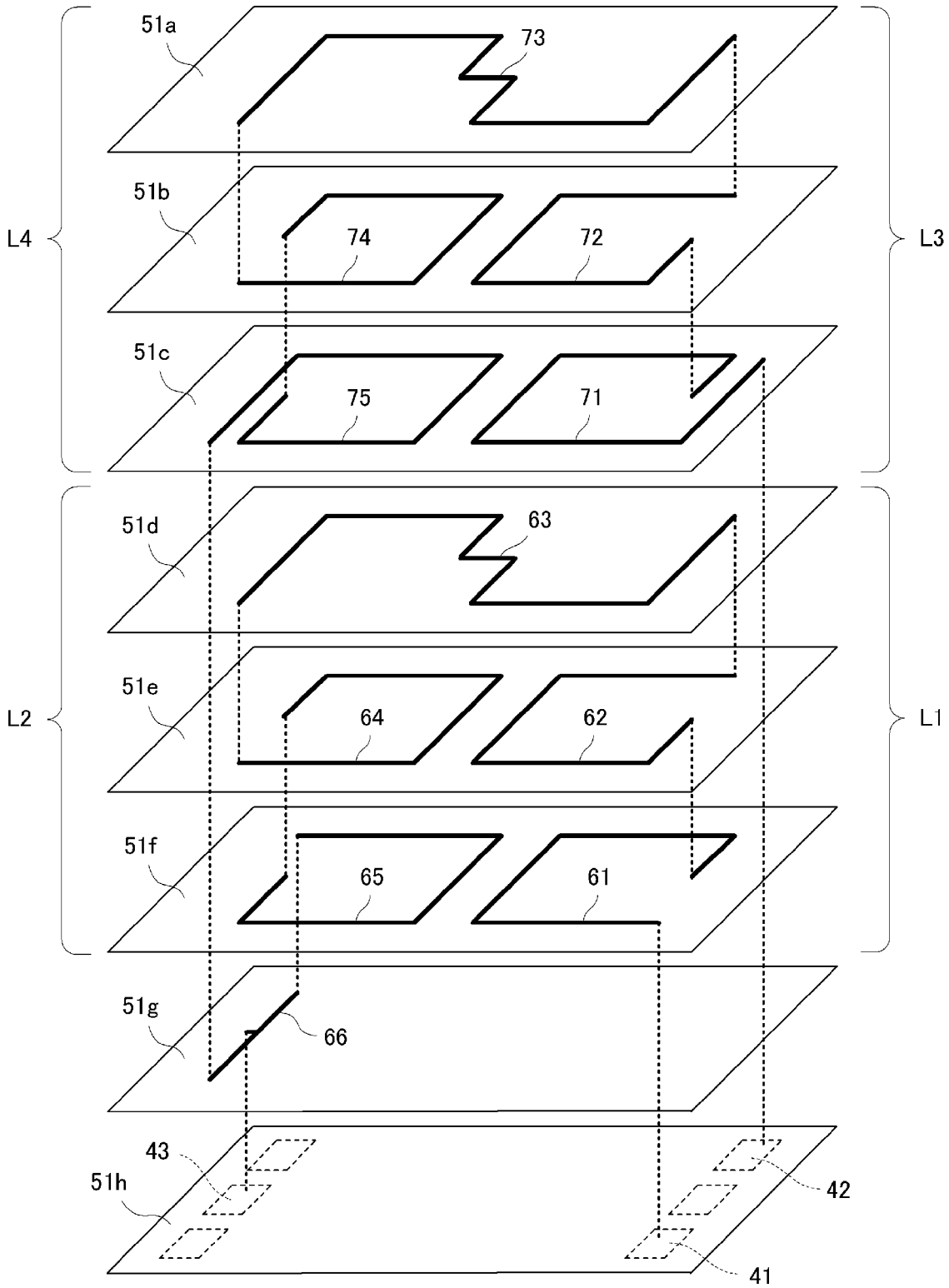
FIG. 22 illustrates an example of a conductive pattern in each layer in the case where a frequency stabilizing circuit according to a thirteenth preferred embodiment is configured in a multilayer substrate.

FIG. 22 illustrates a configuration of a frequency stabilizing circuit according to a thirteenth preferred embodiment and illustrates an example of a conductive pattern on each layer in the case where the frequency stabilizing circuit is configured in a multilayer substrate. The conductive pattern on each layer has a predetermined line width, but it is represented by a simple solid line.

The conductive pattern 73 is disposed on the first layer 51*a* in the range illustrated in FIG. 22, the conductive patterns 72 and 74 are disposed on the second layer 51*b*, and the conductive patterns 71 and 75 are disposed on the third layer 51*c*. The conductive pattern 63 is disposed on the fourth layer 51*d*, the conductive patterns 62 and 64 are disposed on the fifth layer 51*e*, and the conductive patterns 61 and 65 are disposed on the sixth layer 51*f*. The conductive pattern 66 is disposed on the seventh layer 51*g*, and the feeding terminal 41, ground terminal 42, and antenna terminal 43 are disposed on the back side of the eighth layer 51*h*. In FIG. 22, the vertically extending broken lines indicate via electrodes that connect the conductive patterns between the layers. Actually, each of the via electrodes preferably is an electrode having a substantially cylindrical shape with a predetermined diameter dimension, but it is represented by a simple broken line.

In FIG. 22, the conductive patterns 61 and 62 and the right half of the conductive pattern 63 define the first inductance element L1. The conductive patterns 64 and 65 and the left half of the conductive pattern 63 define the second inductance element L2. The conductive patterns 71 and 72 and the right half of the conductive pattern 73 define the third inductance element L3. The conductive patterns 74 and 75 and the left half of the conductive pattern 73 define the fourth inductance element L4.

Figure 23:
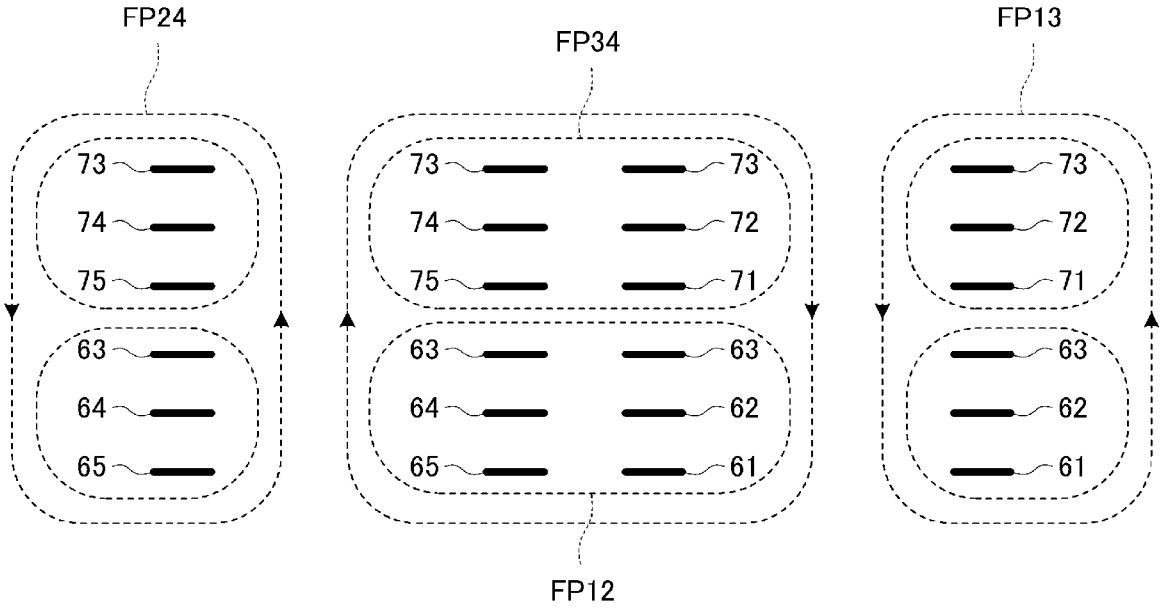
FIG. 23 illustrates main magnetic flux that passes through inductance elements defined by the conductive patterns on the layers of the multilayer substrate illustrated in FIG. 22.
Figure 24:
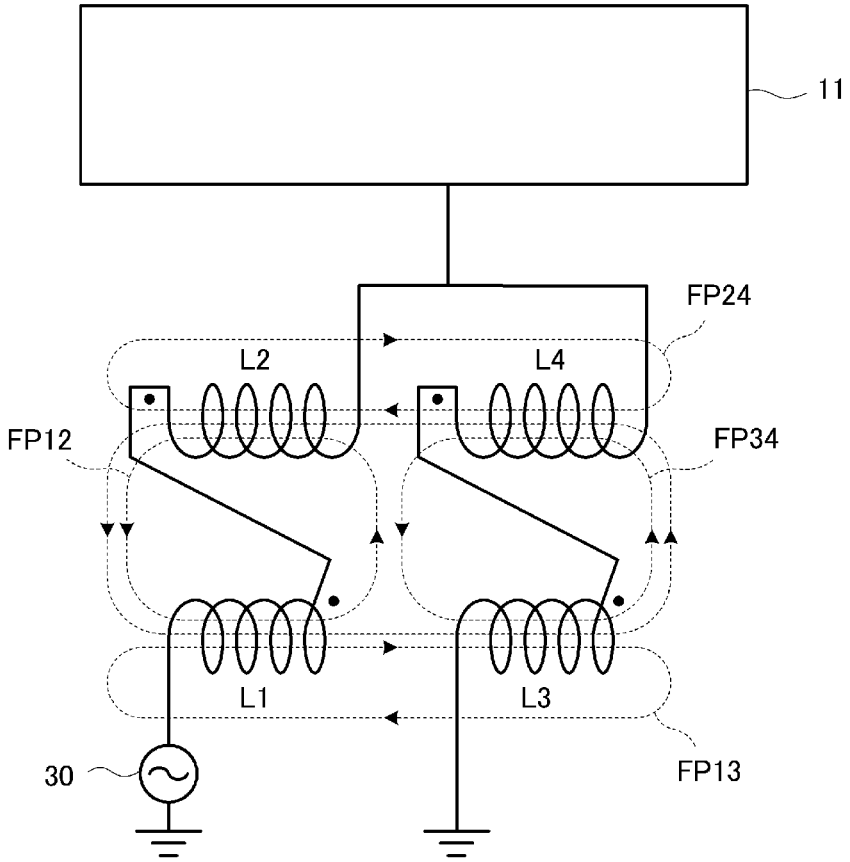
FIG. 24 illustrates a magnetic coupling relationship among the four inductance elements of the frequency stabilizing circuit according to the thirteenth preferred embodiment of the present invention.

FIG. 23 illustrates main magnetic flux passing through the inductance elements defined by the conductive patterns on the layers of the multilayer substrate illustrated in FIG. 22. FIG. 24 illustrates a magnetic coupling relationship among the four inductance elements L1 to L4. The first inductance element L1 and the second inductance element L2 define a closed magnetic circuit as indicated by the magnetic flux FP12. The third inductance element L3 and the fourth inductance element L4 define a closed magnetic circuit as indicated by the magnetic flux FP34. The first inductance element L1 and the third inductance element L3 define a closed magnetic circuit as indicated by magnetic flux FP13. The second inductance element L2 and the fourth inductance element L4 define a closed magnetic circuit as indicated by magnetic flux FP24. In addition, the four inductance elements L1 to L4 define a closed magnetic circuit.

Also with the thirteenth preferred embodiment, the inductance value of the inductance elements L1 and L2 and that of the inductance elements L3 and L4 are reduced by their couplings. Accordingly, the frequency stabilizing circuit illustrated in the thirteenth preferred embodiment also can provide substantially the same advantages as those of the frequency stabilizing circuit 25 of the twelfth preferred embodiment.

Fourteenth Preferred Embodiment

A frequency stabilizing circuit according to a fourteenth preferred embodiment is an example in which an additional circuit is provided to the antenna port of the frequency stabilizing circuit illustrated in the twelfth and thirteenth preferred embodiments.

Figure 25:
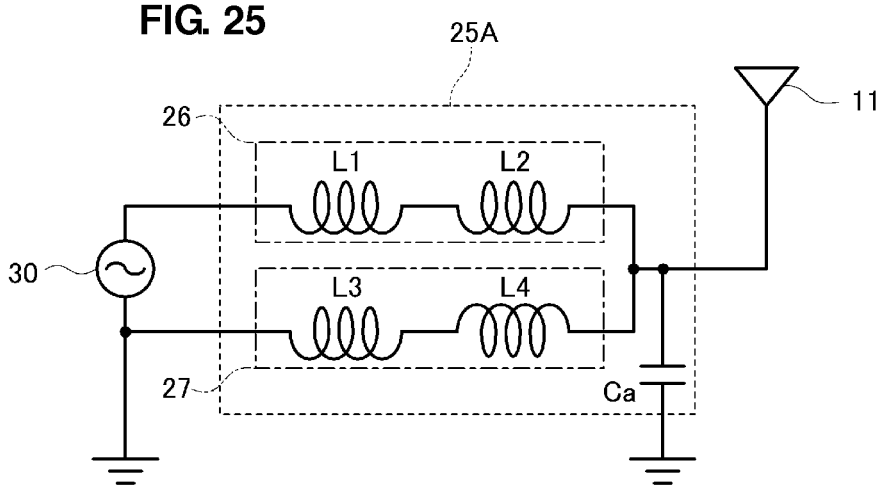
FIG. 25 is a circuit diagram of a frequency stabilizing circuit according to a fourteenth preferred embodiment of the present invention.

FIG. 25 is a circuit diagram of a frequency stabilizing circuit 25A according to the fourteenth preferred embodiment. The frequency stabilizing circuit 25A includes the first series circuit 26 connected to the feeder circuit 30 and the second series circuit 27 electromagnetically coupled to the first series circuit 26. The first series circuit 26 is a series circuit of the first inductance element L1 and the second inductance element L2. The second series circuit 27 is a series circuit of the third inductance element L3 and the fourth inductance element L4. The first series circuit 26 is connected between the antenna port and the feeding port. The second series circuit 27 is connected between the antenna port and the ground. A capacitor Ca is connected between the antenna port and the ground.

Fifteenth Preferred Embodiment

Figure 26:
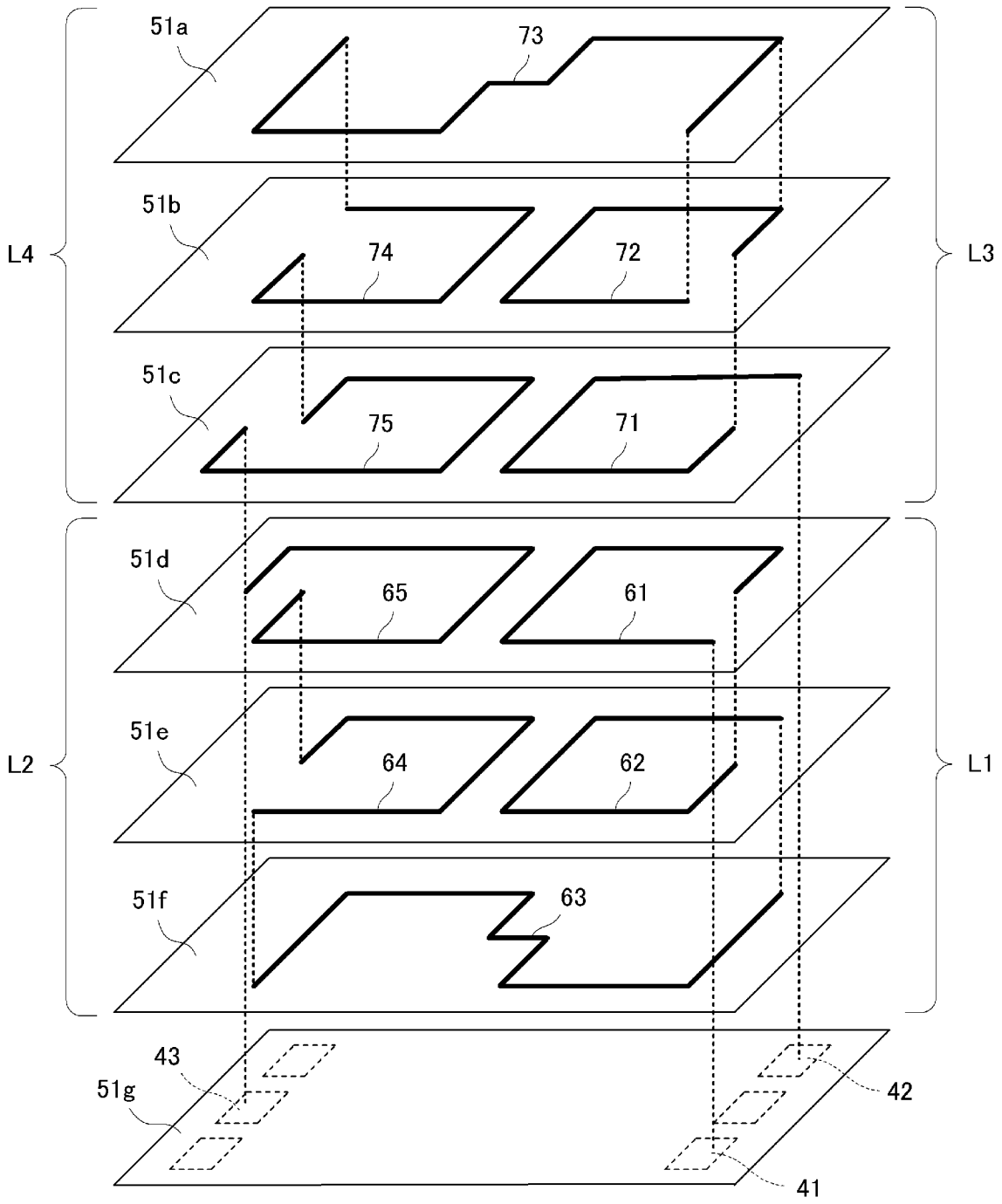
FIG. 26 illustrates an example of a conductive pattern on each layer in the case where a frequency stabilizing circuit according to a fifteenth preferred embodiment of the present invention is configured in a multilayer substrate.

FIG. 26 illustrates an example of a conductive pattern on each layer of a frequency stabilizing circuit configured in a multilayer substrate according to a fifteenth preferred embodiment. Each layer includes a magnetic sheet. The conductive pattern on each layer has a predetermined line width, but it is represented by a simple solid line.

The conductive pattern 73 is disposed on the first layer 51*a* in the range illustrated in FIG. 26, the conductive patterns 72 and 74 are disposed on the second layer 51*b*, and the conductive patterns 71 and 75 are disposed on the third layer 51*c*. The conductive patterns 61 and 65 are disposed on the fourth layer 51*d*, the conductive patterns 62 and 64 are disposed on the fifth layer 51*e*, and the conductive pattern 63 is disposed on the sixth layer 51*f*. The feeding terminal 41, ground terminal 42, and antenna terminal 43 are disposed on the back side of the seventh layer 51*g*. In FIG. 26, the vertically extending broken lines indicate via electrodes that connect the conductive patterns between the layers. Actually, each of the via electrodes is an electrode having a substantially cylindrical shape and a predetermined diameter dimension, but it is represented by a simple broken line.

In FIG. 26, the conductive patterns 61 and 62 and the right half of the conductive pattern 63 define the first inductance element L1. The conductive patterns 64 and 65 and the left half of the conductive pattern 63 define the second inductance element L2. The conductive patterns 71 and 72 and the right half of the conductive pattern 73 define the third inductance element L3. The conductive patterns 74 and 75 and the left half of the conductive pattern 73 define the fourth inductance element L4.

Figure 27:
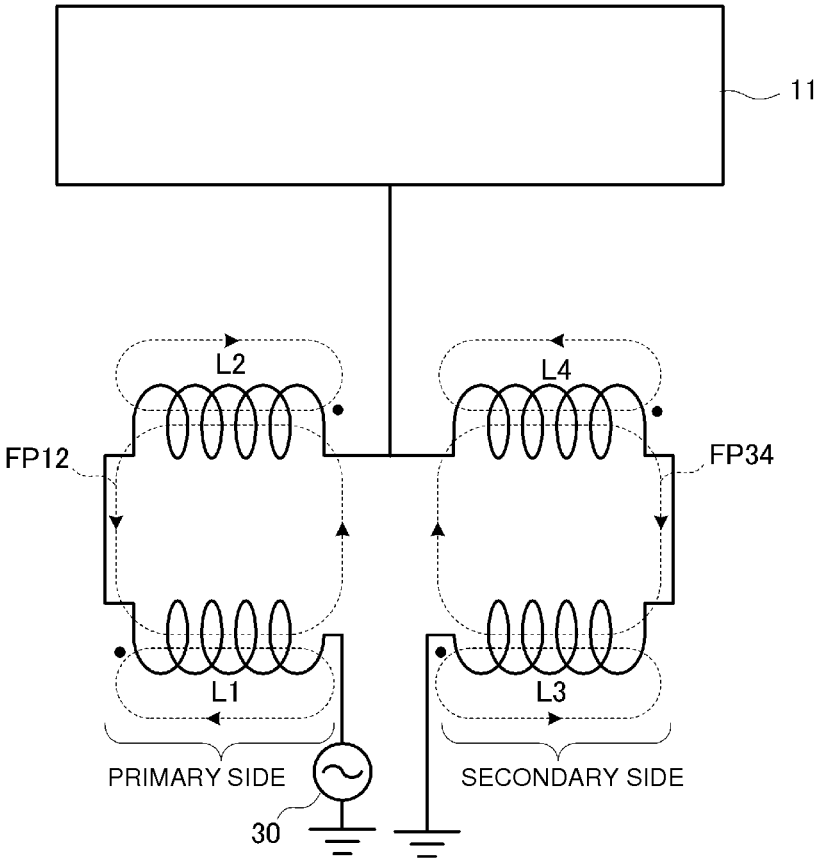
FIG. 27 illustrates a magnetic coupling relationship among four inductance elements of the frequency stabilizing circuit according to the fifteenth preferred embodiment of the present invention.

FIG. 27 illustrates a magnetic coupling relationship among the four inductance elements L1 to L4 of the frequency stabilizing circuit according to the fifteenth preferred embodiment. As illustrated, the first inductance element L1 and the second inductance element L2 define a first closed magnetic circuit (loop indicated by the magnetic flux FP12). The third inductance element L3 and the fourth inductance element L4 define a second closed magnetic circuit (loop indicated by the magnetic flux FP34). The magnetic flux FP12 passing through the first closed magnetic circuit and the magnetic flux FP34 passing through the second closed magnetic circuit are in the opposite directions.

Here, where the first inductance element L1 and the second inductance element L2 are referred to as "primary side," and the third inductance element L3 and the fourth inductance element L4 are referred to as "secondary side," because the feeder circuit is connected to an inductance element in the primary side that is nearer to the secondary side, as illustrated in FIG. 26, the potential of the primary side adjacent to the secondary side can be increased and a current from the feeder circuit can also lead to an induced current that passes through the secondary side. Accordingly, magnetic flux flows as illustrated in FIG. 27.

Also with the configuration of the fifteenth preferred embodiment, because the inductance value of the inductance elements L1 and L2 and that of the inductance elements L3 and L4 are reduced by their couplings, the frequency stabilizing circuit illustrated in the fifteenth preferred embodiment also can provide substantially the same advantages as those of the frequency stabilizing circuit 25 of the twelfth preferred embodiment.

Sixteenth Preferred Embodiment

A frequency stabilizing circuit according to a sixteenth preferred embodiment is a configuration example for increasing the frequency at a self-resonant point of a transformer portion more than that illustrated in each of the twelfth to fifteenth preferred embodiments.

For the frequency stabilizing circuit 35 illustrated in FIG. 3, a self resonance caused by LC resonance resulting from the inductances of the primary series circuit 36 and the secondary series circuit 37 and the capacitance caused between the primary series circuit 36 and the secondary series circuit 37.

Figure 28:
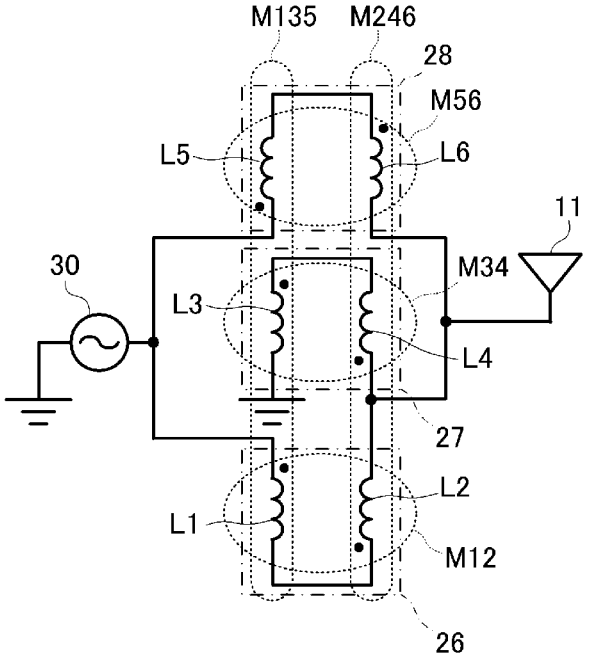
FIG. 28 is a circuit diagram of a frequency stabilizing circuit according to a sixteenth preferred embodiment of the present invention.

FIG. 28 is a circuit diagram of a frequency stabilizing circuit according to a sixteenth preferred embodiment. The frequency stabilizing circuit includes the first series circuit 26 connected between the feeder circuit 30 and the first radiator 11, a third series circuit 28 connected between the feeder circuit 30 and the first radiator 11, and the second series circuit 27 connected between the first radiator 11 and the ground.

The first series circuit 26 is a circuit in which the first inductance element L1 and the second inductance element L2 are connected in series. The second series circuit 27 is a circuit in which the third inductance element L3 and the fourth inductance element L4 are connected in series. The third series circuit 28 is a circuit in which the fifth inductance element L5 and the sixth inductance element L6 are connected in series.

In FIG. 28, an enclosed region M12 indicates the coupling between the inductance elements L1 and L2, an enclosed region M34 indicates the coupling between the inductance elements L3 and L4, and an enclosed region M56 indicates the coupling between the inductance elements L5 and L6. An enclosed region M135 indicates the coupling among the inductance elements L1, L3, and L5. Similarly, an enclosed region M246 indicates the coupling between the inductance elements L2, L4, and L6.

Figure 29:
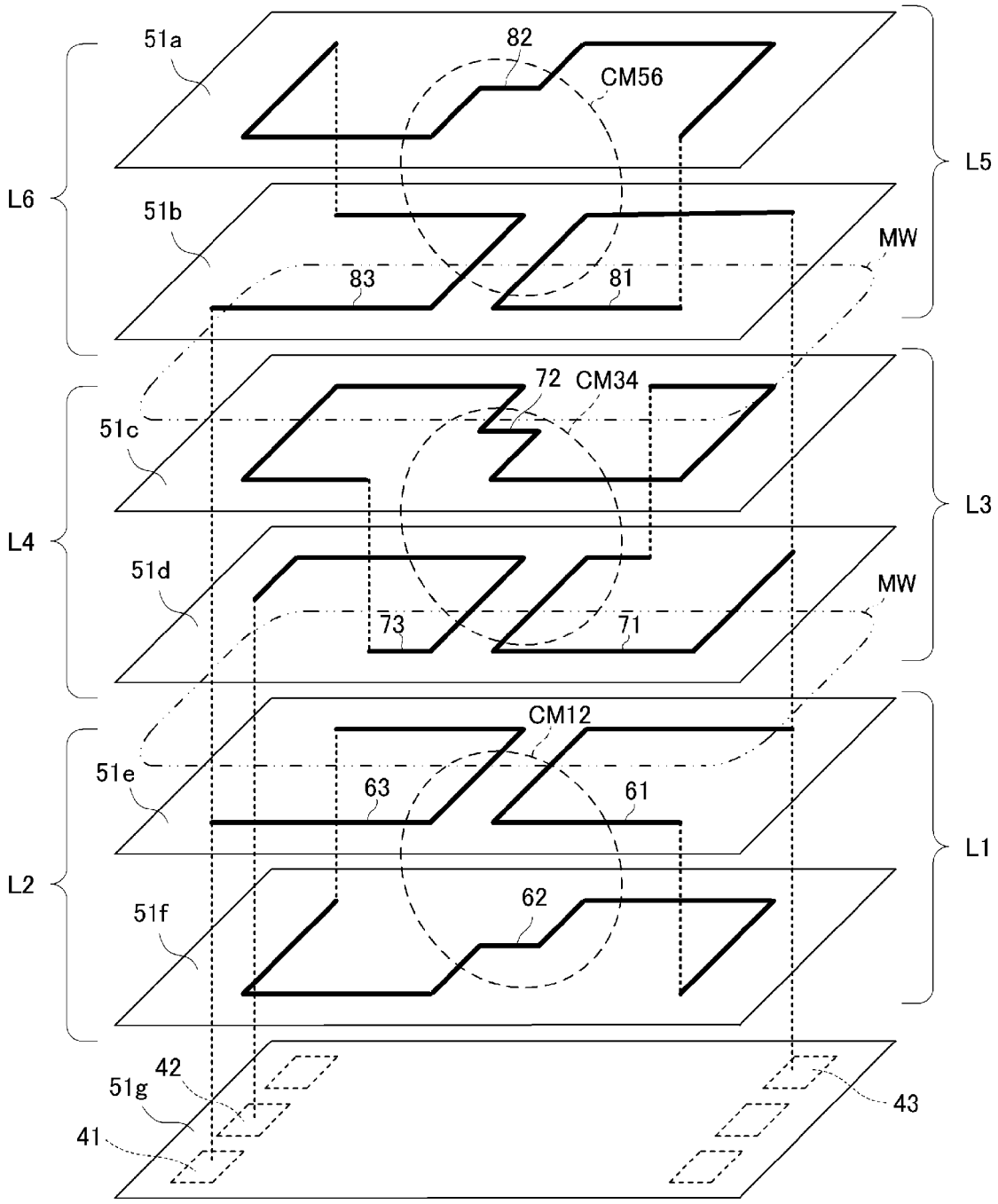
FIG. 29 illustrates an example of a conductive pattern on each layer in the case where the frequency stabilizing circuit according to the sixteenth preferred embodiment of the present invention is configured in a multilayer substrate.

FIG. 29 illustrates an example of a conductive pattern on each layer in the case where the frequency stabilizing circuit according to the sixteenth preferred embodiment is configured in a multilayer substrate. Each of the layers includes a magnetic sheet on which the conductive pattern is disposed. The line conductive pattern has a predetermined line width, but it is represented by a simple solid line.

A conductive pattern 82 is disposed on the first layer 51*a* in the range illustrated in FIG. 29, conductive patterns 81 and 83 are disposed on the second layer 51*b*, and the conductive pattern 72 is disposed on the third layer 51*c*. The conductive patterns 71 and 73 are disposed on the fourth layer 51*d*, the conductive patterns 61 and 63 are disposed on the fifth layer 51*e*, and the conductive pattern 62 is disposed on the sixth layer 51*f*. The feeding terminal 41, ground terminal 42, and antenna terminal 43 are disposed on the back side of the seventh layer 51*g*. In FIG. 29, the vertically extending broken lines indicate via electrodes that connect the conductive patterns between the layers. Actually, each of the via electrodes preferably is an electrode having a substantially cylindrical shape with a predetermined diameter dimension, but it is represented by a simple broken line.

In FIG. 29, the conductive pattern 61 and the right half of the conductive pattern 62 define the first inductance element L1. The conductive pattern 63 and the left half of the conductive pattern 62 define the second inductance element L2. The conductive pattern 71 and the right half of the conductive pattern 72 define the third inductance element L3. The conductive pattern 73 and the left half of the conductive pattern 72 define the fourth inductance element L4. The conductive pattern 81 and the right half of the conductive pattern 82 define the fifth inductance element L5. The conductive pattern 83 and the left half of the conductive pattern 82 define the sixth inductance element L6.

In FIG. 29, the ovals indicated by the broken lines indicate closed magnetic circuits. A closed magnetic circuit CM12 links the inductance elements L1 and L2. A closed magnetic circuit CM34 links the inductance elements L3 and L4. A closed magnetic circuit CM56 links the inductance elements L5 and L6. As described above, the first inductance element L1 and the second inductance element L2 define the first closed magnetic circuit CM12, the third inductance element L3 and the fourth inductance element L4 define the second closed magnetic circuit CM34, and the fifth inductance element L5 and the sixth inductance element L6 define the third closed magnetic circuit CM56. In FIG. 29, the planes indicated by the dash-dot-dot lines are two magnetic walls MW equivalently occurring among the three closed magnetic circuits because each of the inductance elements L1 and L3, the inductance elements L3 and L5, the inductance elements L2 and L4, and the inductance elements L4 and L6 are coupled such that magnetic flux of both of the inductance elements occurs in the opposite directions. In other words, these two magnetic walls MW trap the magnetic flux of the closed magnetic circuit of the inductance elements L1 and L2, the magnetic flux of the closed magnetic circuit of the inductance elements L3 and L4, and the magnetic flux of the closed magnetic circuit L5 and L6.

In this manner, the second closed magnetic circuit CM34 is sandwiched between the first closed magnetic circuit CM12 and the third closed magnetic circuit CM56 in the direction of the layers. With this structure, the second closed magnetic circuit CM34 is sandwiched between the two magnetic walls and is significantly trapped (the effect of being trapped is increased). That is, the action of a transformer having a significantly large coupling coefficient is obtainable.

Accordingly, the gaps between the closed magnetic circuits CM12 and CM34 and between the closed magnetic circuits CM34 and CM56 can be widened to a certain degree. Here, where the circuit in which the series circuit of the inductance elements L1 and L2 and the series circuit of the inductance elements L5 and L6 are connected in parallel is referred to as the primary circuit and the series circuit of the inductance elements L3 and L4 is referred to as the secondary circuit, an increase in the gaps between the closed magnetic circuits CM12 and CM34 and between the closed magnetic circuits CM34 and CM56 can reduce capacitances occurring between the first series circuit 26 and the second series circuit 27 and between the second series circuit 27 and the third series circuit 28. That is, the capacitance component of the LC resonant circuit determining the frequency at the self-resonant point can be reduced.

With the sixteenth preferred embodiment, because of the structure in which the first series circuit 26 of the inductance elements L1 and L2 and the third series circuit 28 of the inductance elements L5 and L6 are connected in parallel, the inductance component of the LC resonant circuit determining the frequency at the self-resonant point can be reduced.

Therefore, both the capacitance component and the reduced inductance component of the LC resonant circuit determining the frequency at the self-resonant point can be reduced, thus allowing the frequency at the self-resonant point to be determined at a high frequency sufficiently distant from the used frequency band.

Seventeenth Preferred Embodiment

A frequency stabilizing circuit according to a seventeenth preferred embodiment is another configuration example for increasing the frequency at a self-resonant point of a transformer portion more than that illustrated in each of the twelfth to fifteenth preferred embodiments, using a configuration different from that of the sixteenth preferred embodiment.

Figure 30:
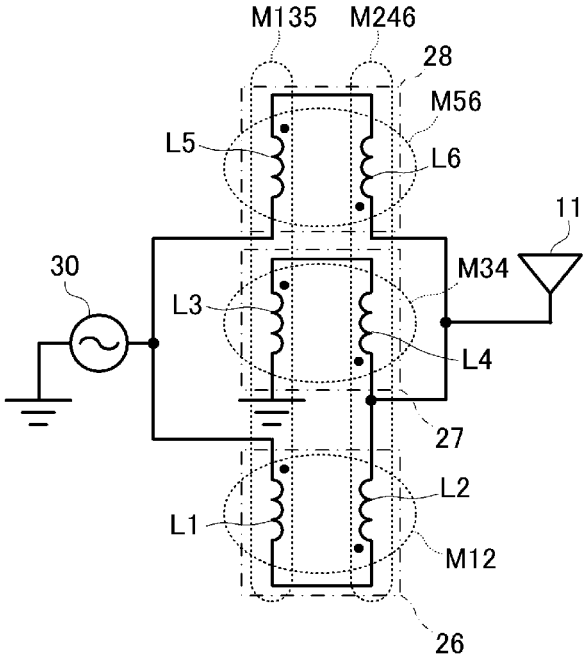
FIG. 30 is a circuit diagram of a frequency stabilizing circuit according to a seventeenth preferred embodiment of the present invention.

FIG. 30 is a circuit diagram of a frequency stabilizing circuit according to the seventeenth preferred embodiment. The frequency stabilizing circuit includes the first series circuit 26 connected between the feeder circuit 30 and the first radiator 11, the third series circuit 28 connected between the feeder circuit 30 and the first radiator 11, and the second series circuit 27 connected between the first radiator 11 and the ground.

The first series circuit 26 is a circuit in which the first inductance element L1 and the second inductance element L2 are connected in series. The second series circuit 27 is a circuit in which the third inductance element L3 and the fourth inductance element L4 are connected in series. The third series circuit 28 is a circuit in which the fifth inductance element L5 and the sixth inductance element L6 are connected in series.

In FIG. 30, the enclosed region M12 indicates the coupling between the inductance elements L1 and L2, the enclosed region M34 indicates the coupling between the inductance elements L3 and L4, and the enclosed region M56 indicates the coupling between the inductance elements L5 and L6. The enclosed region M135 indicates the coupling among the inductance elements L1, L3, and L5. Similarly, the enclosed region M246 indicates the coupling between the inductance elements L2, L4, and L6.

Figure 31:
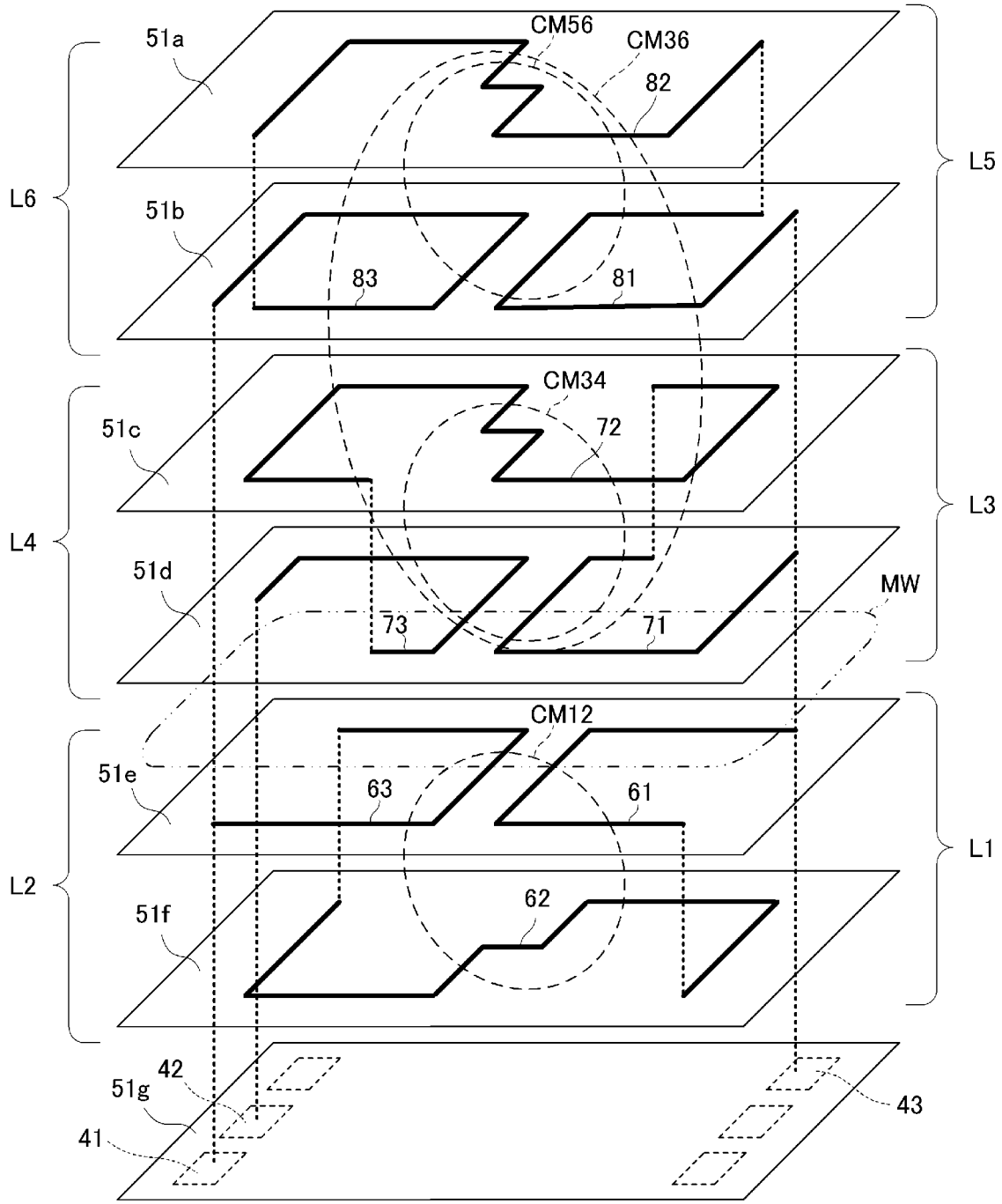
FIG. 31 illustrates an example of a conductive pattern on each layer in the case where the frequency stabilizing circuit according to the seventeenth preferred embodiment of the present invention is configured in a multilayer substrate.

FIG. 31 illustrates an example of a conductive pattern on each layer in the case where the frequency stabilizing circuit according to the seventeenth preferred embodiment is configured in a multilayer substrate. Each of the layers includes a magnetic sheet on which the conductive pattern is disposed. The line conductive pattern has a predetermined line width, but it is represented by a simple solid line.

This frequency stabilizing circuit differs from that illustrated in FIG. 29 in the polarity of each of the inductance elements L5 and L6 formed by the conductive patterns 81, 82, and 83. For the example illustrated in FIG. 31, a closed magnetic circuit CM36 links the inductance elements L3, L5, L6, and L4. Thus, no equivalent magnetic wall occurs between the inductance elements L3 and L4 and the inductance elements L5 and L6. The other configuration is substantially the same as that illustrated in the sixteenth preferred embodiment.

With the seventeenth preferred embodiment, in addition to the closed magnetic circuits CM12, CM34, and CM56, the closed magnetic circuit CM36 occurs, as illustrated in FIG. 31, and thus the magnetic flux resulting from the inductance elements L3 and L4 is absorbed by the magnetic flux resulting from the inductance elements L5 and L6. Accordingly, also with the structure of the seventeenth preferred embodiment, the magnetic flux does not easily leak, and as a result, the action of a transformer having a significantly large coupling coefficient is obtainable.

Also with the seventeenth preferred embodiment, both the capacitance component and the inductance component of the LC resonant circuit determining the frequency at the self-resonant point can be reduced, thus allowing the frequency at the self-resonant point to be determined at a high frequency sufficiently distant from the used frequency band.

Eighteenth Preferred Embodiment

A frequency stabilizing circuit according to an eighteenth preferred embodiment is another configuration example for increasing the frequency at a self-resonant point of a transformer portion more than that illustrated in each of the twelfth to fifteenth preferred embodiments, using a configuration different from those of the sixteenth and seventeenth preferred embodiments.

Figure 32:
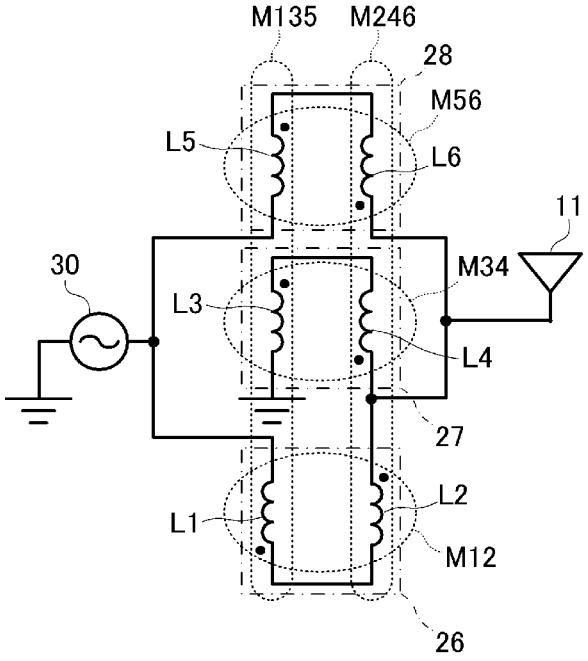
FIG. 32 is a circuit diagram of a frequency stabilizing circuit according to an eighteenth preferred embodiment of the present invention.

FIG. 32 is a circuit diagram of a frequency stabilizing circuit according to the eighteenth preferred embodiment. The frequency stabilizing circuit includes the first series circuit 26 connected between the feeder circuit 30 and the first radiator 11, the third series circuit 28 connected between the feeder circuit 30 and the first radiator 11, and the second series circuit 27 connected between the first radiator 11 and the ground.

Figure 33:
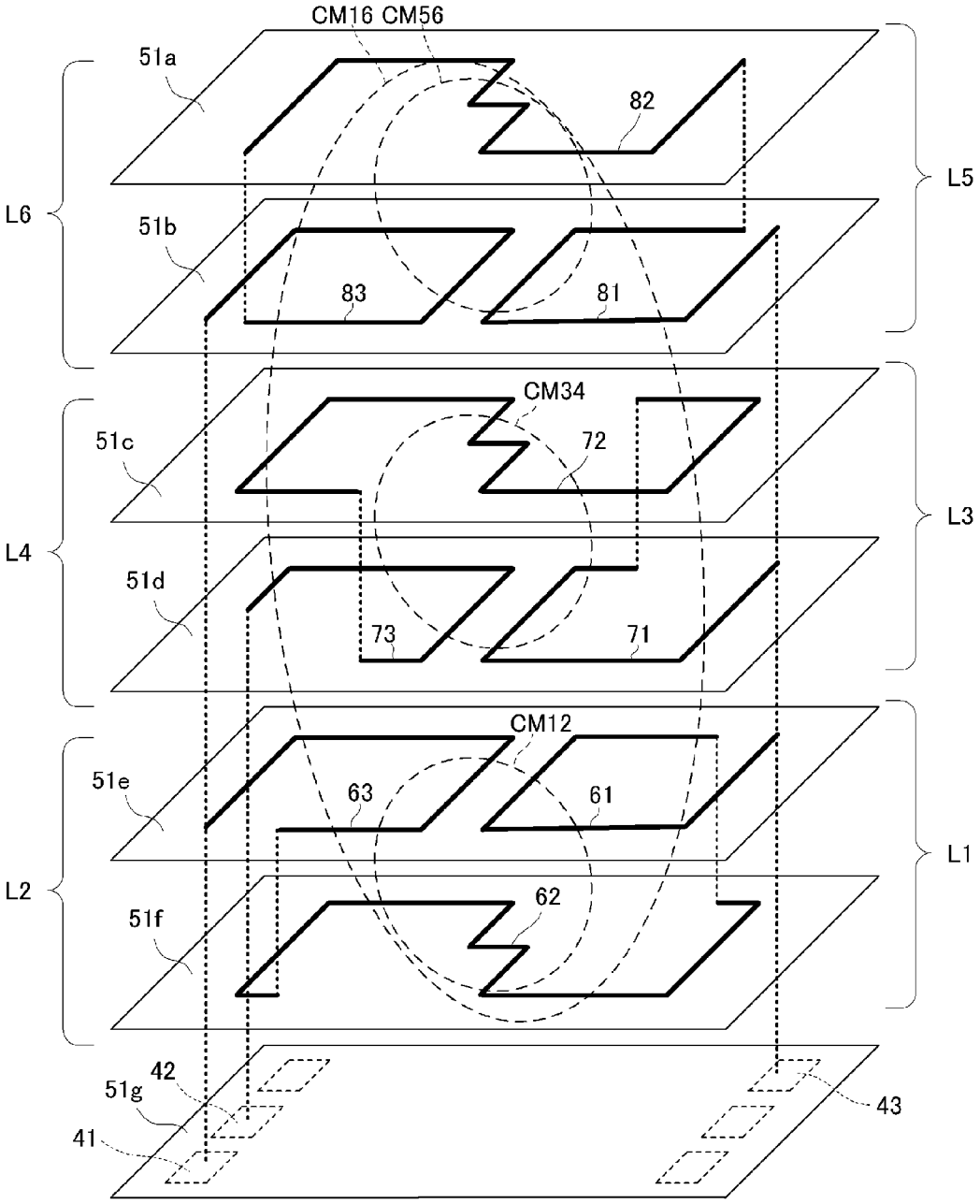
FIG. 33 illustrates an example of a conductive pattern on each layer in the case where the frequency stabilizing circuit according to the eighteenth preferred embodiment of the present invention is configured in a multilayer substrate.
Figure 34:
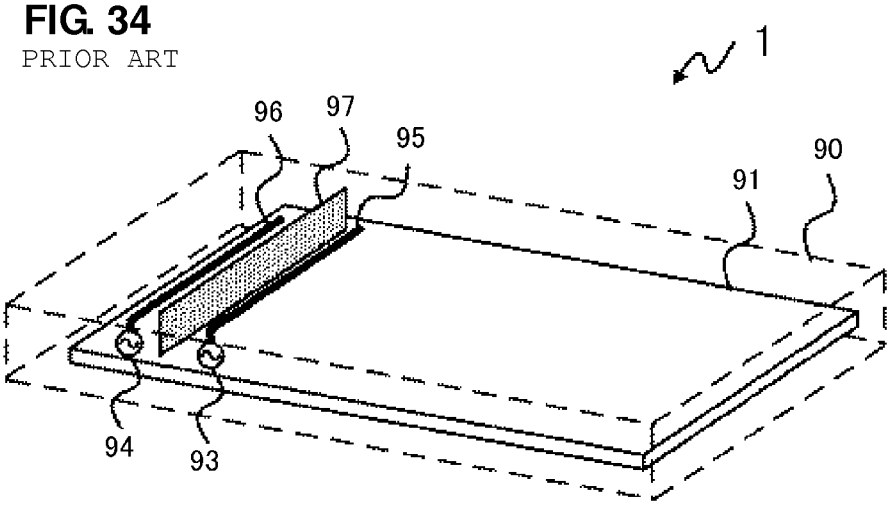
FIG. 34 PRIOR ART
FIG. 34 illustrates a configuration of a traditional wireless device.

FIG. 33 illustrates an example of a conductive pattern on each layer in the case where the frequency stabilizing circuit according to the eighteenth preferred embodiment is configured in a multilayer substrate. Each of the layers includes a magnetic sheet on which the conductive pattern is disposed. The line conductive pattern has a predetermined line width, but it is represented by a simple solid line.

This frequency stabilizing circuit differs from that illustrated in FIG. 29 in the polarity of each of the inductance elements L1 and L2 defined by the conductive patterns 61, 62, and 63 and the polarity of each of the inductance elements L5 and L6 defined by the conductive patterns 81, 82, and 83. For the example illustrated in FIG. 33, a closed magnetic circuit CM16 links all the inductance elements L1 to L6. Thus, no equivalent magnetic wall occurs in this case. The other configuration is substantially the same as those illustrated in the sixteenth and seventeenth preferred embodiments.

With the eighteenth preferred embodiment, in addition to the closed magnetic circuits CM12, CM34, and CM56, the closed magnetic circuit CM16 occurs, as illustrated in FIG. 33. Accordingly, the magnetic flux resulting from the inductance elements L1 to L6 does not easily leak, and as a result, the action of a transformer having a significantly large coupling coefficient is obtainable.

Also with the eighteenth preferred embodiment, both the capacitance component and the inductance component of the LC resonant circuit determining the frequency at the self-resonant point can be reduced, thus allowing the frequency at the self-resonant point to be determined at a high frequency sufficiently distant from the used frequency band.

Nineteenth Preferred Embodiment

A communication terminal apparatus according to a nineteenth preferred embodiment of the present invention includes a frequency stabilizing circuit illustrated in at least one of the first to eighteenth preferred embodiments, a radiator, and a feeder circuit connected to a feeding port of the frequency stabilizing circuit of the frequency stabilizing circuit. The feeder circuit is a high-frequency circuit that includes an antenna switch, a transmission circuit, and a reception circuit. The communication terminal apparatus includes a modulation and demodulation circuit and a baseband circuit, in addition to the above-described components.

The present invention is not limited to an antenna device for use in MIMO. For example, it can also be used in diversity. The first resonant frequency f1 of the first antenna element 11A and the second resonant frequency f2 of the second antenna element 11B illustrated in the above-described preferred embodiments may be different from each other.

While preferred embodiments of the invention have been described above, it is to be understood that variations and modifications will be apparent to those skilled in the art without departing from the scope and spirit of the invention. The scope of the invention, therefore, is to be determined solely by the following claims.

What is claimed is:

1. An antenna device comprising:

a first antenna element that resonates with a first resonant frequency;

a second antenna element that resonates with a second resonant frequency; and at least one frequency stabilizing circuit connected to a feeding end of at least one of the first antenna element and the second antenna element; wherein the at least one frequency stabilizing circuit includes a first series circuit and a second series circuit, the first series circuit includes a first coil conductor and a second coil conductor connected in series to the first coil conductor, the second series circuit includes a third coil conductor and a fourth coil conductor connected in series to the third coil conductor;

the first coil conductor and the second coil conductor are arranged to define a first closed magnetic circuit;

the third coil conductor and the fourth coil conductor are arranged to define a second closed magnetic circuit; and the first closed magnetic circuit and the second closed magnetic circuit are coupled to each other.

2. The antenna device according to claim 1, wherein the first resonant frequency and the second resonant frequency are different from each other.

3. The antenna device according to claim 2, wherein the first resonant frequency and the second resonant frequency differ from a frequency of a communication carrier wave.

4. The antenna device according to claim 3, wherein a first of the at least one frequency stabilizing circuit is connected to the feeding end of the first antenna element and a second of the at least one frequency stabilizing circuit is connected to the feeding end of the second antenna element.

5. The antenna device according to claim 1, wherein the first coil conductor and the third coil conductor are magnetically coupled to each other, and the second coil conductor and the fourth coil conductor are magnetically coupled to each other.

6. The antenna device according to claim 1, wherein the first coil conductor, the second coil conductor, the third coil conductor, and the fourth coil conductor are configured in at least one of a dielectric laminate body and a magnetic laminate body.

7. A communication terminal apparatus comprising:

a first antenna element that resonates with a first resonant frequency;

a second antenna element that resonates with a second resonant frequency; and at least one frequency stabilizing circuit connected to a feeding end of at least one of the first antenna element and the second antenna element; wherein the at least one frequency stabilizing circuit includes a first series circuit and a second series circuit, the first series circuit includes a first coil conductor and a second coil conductor connected in series to the first coil conductor, the second series circuit includes a third coil conductor and a fourth coil conductor connected in series to the third coil conductor;

the first coil conductor and the second coil conductor are arranged to define a first closed magnetic circuit;

the third coil conductor and the fourth coil conductor are arranged to define a second closed magnetic circuit; and the first closed magnetic circuit and the second closed magnetic circuit are coupled to each other.

* * * * *